US011547626B2

(12) United States Patent
Murison

(10) Patent No.: US 11,547,626 B2
(45) Date of Patent: Jan. 10, 2023

(54) DEVICES EXPLOITING HOLLOW MOTORS

(71) Applicant: OBOTICS INC., North Gower (CA)

(72) Inventor: Bruce Murison, North Gower (CA)

(73) Assignee: Obotics Inc., North Gower (CA)

( * ) Notice: Subject to any disclaimer, the term of this patent is extended or adjusted under 35 U.S.C. 154(b) by 741 days.

(21) Appl. No.: 16/336,721

(22) PCT Filed: Sep. 27, 2017

(86) PCT No.: PCT/CA2017/000210
§ 371 (c)(1),
(2) Date: Mar. 26, 2019

(87) PCT Pub. No.: WO2018/058234
PCT Pub. Date: Apr. 5, 2018

(65) Prior Publication Data

US 2020/0060928 A1 Feb. 27, 2020

Related U.S. Application Data

(60) Provisional application No. 62/400,145, filed on Sep. 27, 2016.

(51) Int. Cl.

| | |
|---|---|
| ***A61H 19/00*** | (2006.01) |
| ***A61H 23/02*** | (2006.01) |
| ***A61H 23/04*** | (2006.01) |

(52) U.S. Cl.
CPC ..... *A61H 19/32* (2013.01); *A61H 19/34* (2013.01); *A61H 19/44* (2013.01); *A61H 23/02* (2013.01); *A61H 23/0263* (2013.01); *A61H 23/04* (2013.01); *A61H 2201/123* (2013.01); *A61H 2201/1692* (2013.01); *A61H 2201/5012* (2013.01)

(58) Field of Classification Search
CPC ..... A61H 19/32; A61H 19/34; A61H 19/44; A61H 23/02; A61H 23/0263
See application file for complete search history.

(56) References Cited

U.S. PATENT DOCUMENTS

| | | | | |
|---|---|---|---|---|
| 7,648,471 | B2 * | 1/2010 | Hobson | A61B 8/406 601/78 |
| 10,483,784 | B2 * | 11/2019 | Konik | A61B 5/1118 |
| 2003/0083598 | A1 * | 5/2003 | Kobayashi | A61H 19/50 601/DIG. 16 |
| 2003/0181835 | A1 * | 9/2003 | Klein | A61H 19/30 601/72 |

(Continued)

*Primary Examiner* — John P Lacyk
(74) *Attorney, Agent, or Firm* — Rosenberg, Klein & Lee

(57) ABSTRACT

Vibration based stimulation or pressure based stimulation are commonly employed in a wide range of devices for medical, therapeutic, and recreational activities. These are designed to be applied against a predetermined region of a user's body. However, there are many instances where it would beneficial to provide the user with a "wearable" device where these one or more predetermined regions of the user's body may be inserted through or disposed within the device providing vibratory and/or pressure based stimulation. Further, such devices may be augmented with other therapeutic means such as light therapy or ultrasonic therapy. Accordingly, a range of wearable devices exploiting hollow shaft motors, electromagnetic actuators, and fluidics are presented.

14 Claims, 22 Drawing Sheets

(56) References Cited

U.S. PATENT DOCUMENTS

| | | | | |
|---|---|---|---|---|
| 2004/0020241 | A1* | 2/2004 | Boiadjian | A61H 19/34<br>63/15 |
| 2005/0283044 | A1* | 12/2005 | Chang | A61F 5/41<br>600/38 |
| 2008/0027361 | A1* | 1/2008 | Lin | A61H 19/50<br>601/46 |
| 2009/0318755 | A1* | 12/2009 | Adams | A61H 23/0263<br>600/41 |

* cited by examiner

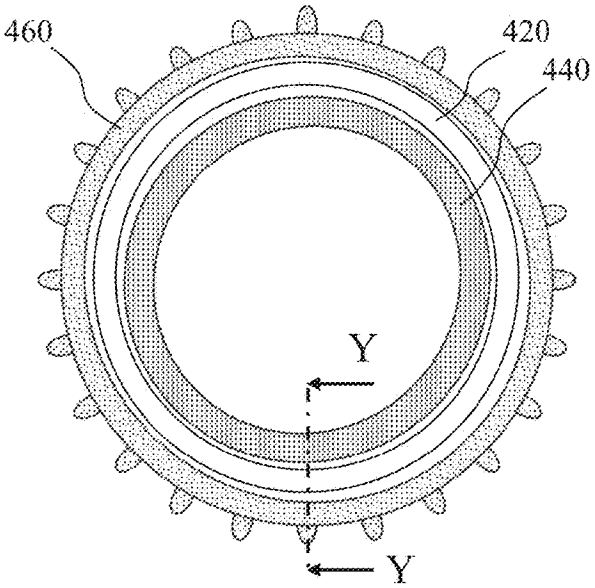
Figure 4D
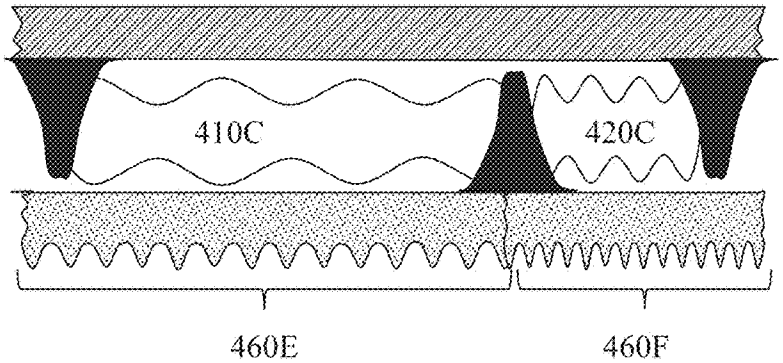
Figure 4C
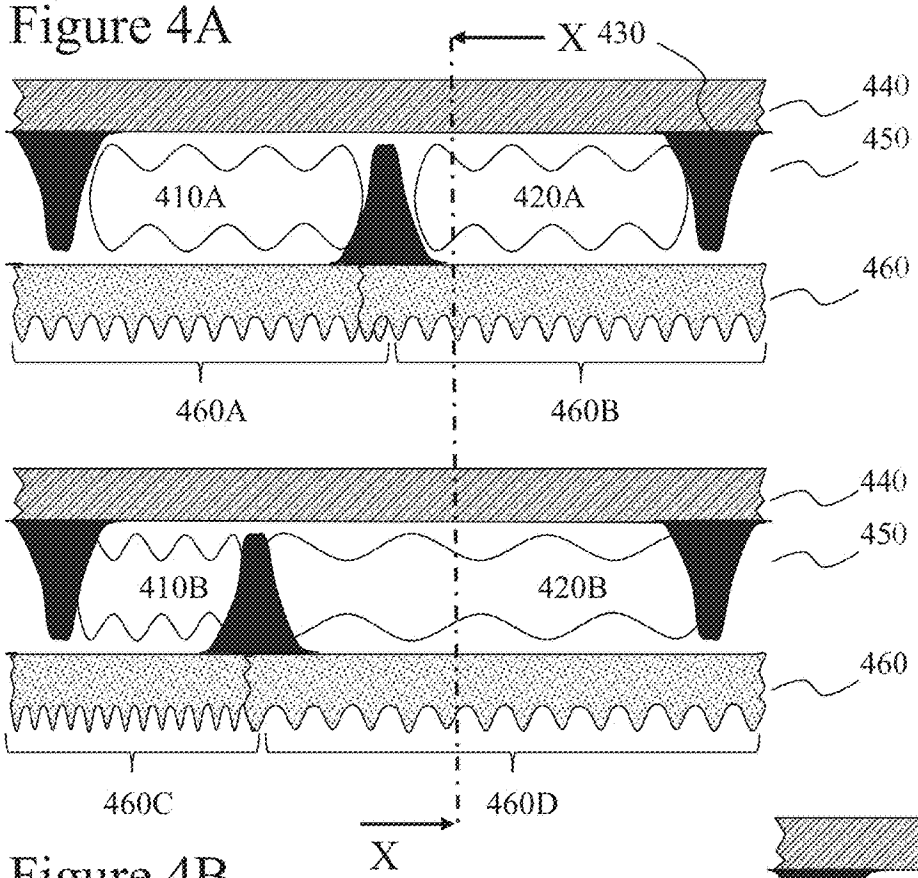
Figure 4A
Figure 4B

DEVICES EXPLOITING HOLLOW MOTORS

CROSS REFERENCE TO RELATED APPLICATIONS

This patent application claims the benefit of priority as a 371 national phase entry application of PCT/CA2017/000,210 filed Sep. 27, 2017 entitled "Devices Exploiting Hollow Motors" and therein to U.S. Provisional Patent Application 62/400,145 filed on Sep. 27, 2016 entitled "Devices Exploiting Hollow Motors", the entire contents of which are included herein by reference.

FIELD OF THE INVENTION

This invention relates to devices and more particularly to the provisioning of devices wherein the motive means and mechanical actuators are provided in a manner allowing insertion of a part of the human body such that the device is wearable.

BACKGROUND OF THE INVENTION

Devices that apply pressure either continuously, intermittently, or with one or more characteristic frequencies to one or more regions of a user's body are associated with a range of medical, therapeutic, and recreational activities. For example, massage devices or massagers provide for mechanical pressure application to compliment or replace the user of a massager's fingers, palms, hands, etc. and are employed both by medical/therapy professionals and consumers alike. Those imparting generally more localized higher frequency stimulation to the user's body have evolved to include those for medical/therapeutic use but also to include recreational activities primarily of a sexual nature and are commonly referred to as vibrators. In fact, one of the most successful vibrators for sexual stimulation, the Hitachi Magic Wand (renamed as Magic Wand Original, Original Magic Wand or referred to simply as Magic Wand) was an electrical, AC-powered vibrating massager, originally manufactured and marketed for relieving tension and relaxing sore muscles before becoming a popular vibrator for clitoral stimulation.

Medical and therapeutic massagers tend to be larger devices which are electrical mains powered (e.g. typically alternating current or AC) whereas except for some niche devices and wand style massagers vibrators targeted as sexual therapeutic use are usually battery powered (e.g. direct current, DC) devices due to the eased use without an electrical cord (cable) and requirement for an electrical outlet within range of the location of use. Accordingly, such vibrators form a significant portion of the overall retail market and product offerings within what are commonly referred to as sex toys or adult devices.

A sex toy or adult device is an object or device that is primarily used to facilitate human sexual pleasure which are typically designed to resemble human genitals and may be mechanized and non-mechanized. Mechanized adult devices typically vibrate, although there are examples that rotate, thrust, and even circulate small beads within an elastomeric shell. Non-mechanized adult devices are made from a solid mass of rigid or semi-rigid material in a variety of shapes. Accordingly, today, a wide range of adult devices are offered commercially to users with the majority of them falling into several broad categories including clitoral, (G-spot), dildo, rabbit (generally comprising two vibrators, one phallus-like shaped intended for insertion and a second smaller clitoral stimulator), egg (small smooth vibrators for external or internal stimulation although now offered in a range of shapes), anal, penis ring, bullet (small cylindrical vibrators), c-shaped (for generally hands free use by insertion into the vagina with one or two vibrators for clitoral and/or g-spot stimulation including variants for use during penile penetration) and Butterfly (generally a vibrator with straps). All of these are generally "hand-held" devices with a "solid" casing or shell such that the user stimulates themselves or another through the external surface of the adult device. The exceptions are a penis ring, which is intended to sit at the base of the penile shaft and vibrate against the clitoral region of a female partner during vaginal penetration, and a male adult device intended for the penis to be inserted and stimulated either through a range of vibrations and movements associated with the penis.

In addition to the above general categories there are adult device variants including, but not limited to, dual vibrators (designed to stimulate two erogenous zones simultaneously or independently), triple vibrators (designed to stimulate three erogenous zones simultaneously or independently), double-ended (for vaginal-vaginal, vaginal-anal, or anal-anal stimulation); nipple stimulators, and electrostimulators. Some other devices such as Kegel balls or Ben-Wa balls which are ostensibly aimed at vaginal muscle exercises etc. can include vibrating elements and are also generally categorized under adult devices.

However, the majority of prior art devices are designed and intended for, what the inventor refers to as, a discrete penetrative act in that they are primarily intended for penetration of an orifice in isolation from and disconnected with any penetration of the orifice by an individual's or the individual's partner rather than enhanced penetrative act provided by embodiments of the invention wherein the penetrative act is enhanced/augmented through an adult device which is worn by an individual's partner or employed in conjunction with a penetrative adult device. Here, the penis ring is excluded by the inventor as it is not enhancing the penetrative act but rather providing a secondary stimulation in that whilst it is worn on an individual's penis and vibrates it does so against the external clitoral region of the user. In contrast, so-called C-shaped devices provide hands-free stimulation of the individual's clitoris and g-spot with optional concurrent penetration. However, these are inserted and removed discretely from the penetrative act itself.

Accordingly, the inventor has established that it would be beneficial to provide users with a range of adult devices that support use in association with their use of a predetermined region of their body, e.g. the penis, tongue, toe(s), and finger(s), for example, such that can be considered wearable adult device or adult devices that are worn during concurrent with penetrative sexual activities In order to provide such wearable devices it would therefore be beneficial for one or more of these predetermined regions of the body to be through or within the adult device such that the adult device has a hollow shaft. Further, such hollow shaft devices for augmented or enhanced penetrative activities yield a variable engagement with the individual based upon the penetrative activity of another adult device to which the hollow shaft adult device is mounted or another individual's body region. The inventor has also established that such wearable devices with hollow shafts also provide for a range of massage and therapeutic devices.

Other aspects and features of the present invention will become apparent to those ordinarily skilled in the art upon review of the following description of specific embodiments of the invention in conjunction with the accompanying figures.

SUMMARY OF THE INVENTION

It is an object of the present invention to mitigate limitations within the prior art relating to devices and more particularly to the provisioning of devices wherein the motive means and mechanical actuators are provided in a manner allowing insertion of a part of the human body such that the device is wearable.

In accordance with an embodiment of the invention there is provided a device comprising:

an annular region configured to receive a defined body portion of a user;

an outer casing of predetermined geometry and dimensions; wherein the annular region is within the central opening of an electrical hollow shaft motor which imparts a first physical sensation to the user's defined body portion.

In accordance with an embodiment of the invention there is provided a device comprising:

an annular region configured to fit over a defined body portion of a user;

an outer casing of predetermined geometry and dimensions; wherein the annular region is within the central opening of an electrical hollow shaft motor which imparts a first physical sensation to the user's defined body portion.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIGS. 3F to 31 depict lateral cross-sections through the supporting body portion of hollow shaft devices according to embodiments of the invention exploiting fluidic actuators;

FIGS. 4A to 4C depict longitudinal cross-sections along the supporting body portion of hollow shaft devices according to embodiments of the invention exploiting fluidic actuators;

FIGS. 4D to 4F depict lateral cross-sections through the supporting body portions of hollow shaft devices of FIGS. 4A to 4C according to embodiments of the invention exploiting fluidic actuators;

FIG. 8 depicts a combinational set of hollow shaft devices according to embodiments of the invention exploiting hollow shaft motors;

FIG. 9 depicts a wireless portable electronic device supporting communications to a network and supporting communications to devices according to embodiments of the invention such as described supra in respect of FIGS. 2A to 8 respectively.

DETAILED DESCRIPTION

Figure 1A:
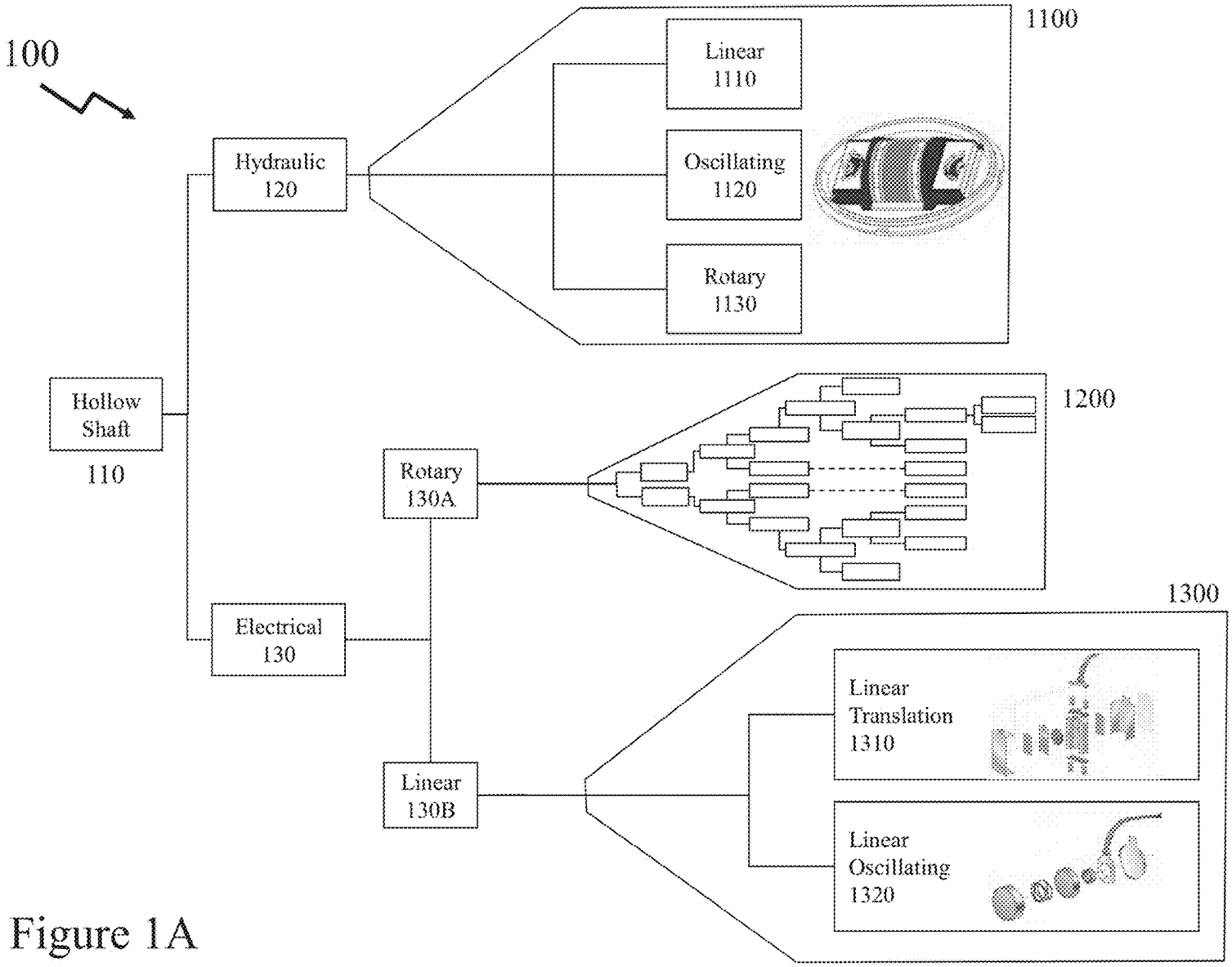
FIG. 1A depicts a classification tree for hollow shaft devices employing hydraulic, linear electrical, or rotary electrical actuation means according to embodiments of the invention.

The present invention is directed to devices and more particularly to the provisioning of devices wherein the motive means and mechanical actuators are provided in a manner allowing insertion of a part of the human body such that the device is wearable.

The ensuing description provides representative embodiment(s) only, and is not intended to limit the scope, applicability or configuration of the disclosure. Rather, the ensuing description of the embodiment(s) will provide those skilled in the art with an enabling description for implementing an embodiment or embodiments of the invention. It being understood that various changes can be made in the function and arrangement of elements without departing from the spirit and scope as set forth in the appended claims. Accordingly, an embodiment is an example or implementation of the inventions and not the sole implementation. Various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention can also be implemented in a single embodiment or any combination of embodiments.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions. The phraseology and terminology employed herein is not to be construed as limiting but is for descriptive purpose only. It is to be understood that where the claims or specification refer to "a" or "an" element, such reference is not to be construed as there being only one of that element. It is to be understood that where the specification states that a component feature, structure, or characteristic "may", "might", "can" or "could" be included, that particular component, feature, structure, or characteristic is not required to be included.

Reference to terms such as "left", "right", "top", "bottom", "front" and "back" are intended for use in respect to the orientation of the particular feature, structure, or element within the figures depicting embodiments of the invention. It would be evident that such directional terminology with respect to the actual use of a device has no specific meaning as the device can be employed in a multiplicity of orientations by the user or users. Reference to terms "including", "comprising", "consisting" and grammatical variants thereof do not preclude the addition of one or more components, features, steps, integers or groups thereof and that the terms are not to be construed as specifying components, features, steps or integers. Likewise, the phrase "consisting essentially of", and grammatical variants thereof, when used herein is not to be construed as excluding additional components, steps, features integers or groups thereof but rather that the additional features, integers, steps, components or groups thereof do not materially alter the basic and novel characteristics of the claimed composition, device or method. If the specification or claims refer to "an additional" element, that does not preclude there being more than one of the additional element.

A "portable electronic device" (PED) as used herein and throughout this disclosure refers to, but is not limited to, a wireless device used for communications and other applications that requires a battery or other independent form of energy for power. This includes devices, but is not limited to, such as a cellular telephone, smartphone, personal digital assistant (PDA), portable computer, pager, portable multimedia player, portable gaming console, laptop computer, tablet computer, a wearable device and an electronic reader.

A "fixed electronic device" (FED) as used herein and throughout this disclosure refers to, but is not limited to, a wireless and/or wired device used for communications and other applications that requires connection to a fixed interface to obtain power. This includes, but is not limited to, a laptop computer, a personal computer, a computer server, a kiosk, a gaming console, a digital set-top box, an analog set-top box, an Internet enabled appliance, an Internet enabled television, and a multimedia player.

A "server" as used herein, and throughout this disclosure refers to, but is not limited to, one or more physical computers co-located and/or geographically distributed running one or more services as a host to users of other computers, PEDs, FEDs, etc. to serve the client needs of these other users. This includes, but is not limited to, a database server, file server, mail server, print server, web server, gaming server, or virtual environment server.

An "application" (commonly referred to as an "app") as used herein and throughout this disclosure may refer to, but is not limited to, a "software application", an element of a "software suite", a computer program designed to allow an individual to perform an activity, a computer program designed to allow an electronic device to perform an activity, and a computer program designed to communicate with local and/or remote electronic devices. An application thus differs from an operating system (which runs a computer), a utility (which performs maintenance or general-purpose chores), and a programming tools (with which computer programs are created). Generally, within the following description with respect to embodiments of the invention an application is generally presented in respect of software permanently and/or temporarily installed upon a PED and/or FED.

A "social network" or "social networking service" as used herein and throughout this disclosure may refer to, but is not limited to, a platform to build social networks or social relations among people who may, for example, share interests, activities, backgrounds, or real-life connections. This includes, but is not limited to, social networks such as U.S. based services such as Facebook, Google+, Tumblr and Twitter; as well as Nexopia, Badoo, Bebo, VKontakte, Delphi, Hi5, Hyves, iWiW, Nasza-Klasa, Soup, Glocals, Skyrock, The Sphere, StudiVZ, Tagged, Tuenti, XING, Orkut, Mxit, Cyworld, Mixi, renren, weibo and Wretch.

"Social media" or "social media services" as used herein and throughout this disclosure may refer to, but is not limited to, a means of interaction among people in which they create, share, and/or exchange information and ideas in virtual communities and networks. This includes, but is not limited to, social media services relating to magazines, Internet forums, weblogs, social blogs, microblogging, wikis, social networks, podcasts, photographs or pictures, video, rating and social bookmarking as well as those exploiting blogging, picture-sharing, video logs, wall-posting, music-sharing, crowdsourcing and voice over IP, to name a few. Social media services may be classified, for example, as collaborative projects (for example, Wikipedia); blogs and microblogs (for example, Twitter™); content communities (for example, YouTube and DailyMotion); social networking sites (for example, Facebook™); virtual game-worlds (e.g., World of Warcraft™); and virtual social worlds (e.g. Second Life™).

An "enterprise" as used herein and throughout this disclosure may refer to, but is not limited to, a provider of a service and/or a product to a user, customer, or consumer. This includes, but is not limited to, a retail outlet, a store, a market, an online marketplace, a manufacturer, an online retailer, a charity, a utility, and a service provider. Such enterprises may be directly owned and controlled by a company or may be owned and operated by a franchisee under the direction and management of a franchiser.

A "service provider" as used herein and throughout this disclosure may refer to, but is not limited to, a third party provider of a service and/or a product to an enterprise and/or individual and/or group of individuals and/or a device comprising a microprocessor. This includes, but is not limited to, a retail outlet, a store, a market, an online marketplace, a manufacturer, an online retailer, a utility, an own brand provider, and a service provider wherein the service and/or product is at least one of marketed, sold, offered, and distributed by the enterprise solely or in addition to the service provider.

A "third party" or "third party provider" as used herein and throughout this disclosure may refer to, but is not limited to, a so-called "arm's length" provider of a service and/or a product to an enterprise and/or individual and/or group of individuals and/or a device comprising a microprocessor wherein the consumer and/or customer engages the third party but the actual service and/or product that they are interested in and/or purchase and/or receive is provided through an enterprise and/or service provider.

A "user" as used herein and throughout this disclosure may refer to, but is not limited to, an individual or group of individuals. This includes, but is not limited to, private individuals, employees of organizations and/or enterprises, members of community organizations, members of charity organizations, men and women. In its broadest sense the user may further include, but not be limited to, animals, mechanical systems, robotic systems, android systems, etc. that may be characterised by an ability to exploit one or more embodiments of the invention. A user may be associated with biometric data which may be, but not limited to, monitored, acquired, stored, transmitted, processed and analysed either locally or remotely to the user. A user may also be associated through one or more accounts and/or profiles with one or more of a service provider, third party provider, enterprise, social network, social media etc. via a dashboard, web service, website, software plug-in, software application, and graphical user interface.

"User information" as used herein and throughout this disclosure may refer to, but is not limited to, user behavior information and/or user profile information. It may also include a user's biometric information, an estimation of the user's biometric information, or a projection/prediction of a user's biometric information derived from current and/or historical biometric information.

A "wearable device" or "wearable sensor" as used herein and throughout this disclosure may refer to, but is not limited to, a miniature electronic device that are worn by the user including those under, within, with or on top of clothing and are part of a broader general class of wearable technology which includes "wearable computers" which in contrast are directed to general or special purpose information technologies and media development. Such wearable devices and/or wearable sensors may include, but not be limited to, smartphones, smart watches, e-textiles, smart shirts, activity trackers, smart glasses, environmental sensors, medical sensors, biological sensors, physiological sensors, chemical sensors, ambient environment sensors, position sensors, neurological sensors, drug delivery systems, medical testing and diagnosis devices, and motion sensors. The wearable devices and/or wearable sensors may include, but not be limited to, devices that can stimulate and/or measure parameters that are designed to fit on or near the perineum, anal area, vagina, clitoral area, and nipples.

"Biometric" information as used herein and throughout this disclosure may refer to, but is not limited to, data relating to a user characterised by data relating to a subset of conditions including, but not limited to, their environment, medical condition, biological condition, physiological condition, chemical condition, ambient environment condition, position condition, neurological condition, drug condition, and one or more specific aspects of one or more of these said conditions. Accordingly, such biometric information may include, but not be limited, blood oxygenation, blood pressure, blood flow rate, heart rate, temperate, fluidic pH, viscosity, particulate content, solids content, altitude, vibration, motion, perspiration, EEG, ECG, energy level, etc. In addition, biometric information may include data relating to physiological characteristics related to the shape and/or condition of the body wherein examples may include, but are not limited to, fingerprint, facial geometry, baldness, DNA, hand geometry, odour, and scent. Biometric information may also include data relating to behavioral characteristics, including but not limited to, typing rhythm, gait, and voice.

A "device" as used herein and throughout this disclosure may refer to, but is not limited to, a device intended for use by an individual or user themselves or in conjunction with activities with another individual or user which can provide one or more functions including, but not limited to, those of a massager, a massage device, and an adult device.

A "massager" or "massage device" as used herein and throughout this disclosure may refer to, but is not limited to, a device which functions by working and acting on one or more regions of the body of the user or another user with pressure.

An "adult device" (ADDEV), "sexual pleasure device", or "sex toy" as used herein and throughout this disclosure may refer to, but is not limited to, a sexual pleasure device intended for use by an individual or user themselves or in conjunction with activities with another individual or user which can provide one or more functions including, but not limited to, those of a dildo and a vibrator. The adult device can be designed to have these functions in combination with design features that are intended to be penetrative or non-penetrative, provide vibratory and non-vibratory mechanical functions, or be passive. Such adult devices can be designed for use with one or more regions of the male and female bodies including but not limited to, the clitoris, the clitoral area (which is the area surrounding and including the clitoris), vagina, rectum, nipples, breasts, penis, testicles, prostate, and "G-spot." In one example a "male adult device" is an adult device configured to receive a user's penis within a cavity or recess. In another example, a "female adult device" is an adult device having at least a portion configured to be inserted in a user's vagina or rectum. It should be understood that the user of a female adult device can be a male or a female when it is used for insertion in a user's rectum. Such adult devices may employ one or more actuation mechanisms when providing vibratory and non-vibratory mechanical functions including, but not limited to, motors, motors with off-axis weights, linear motors, screw drives, fluidic pumps, fluidic actuators, and piezoelectric elements. Some adult devices may provide an electrical stimulatory function discretely or in combination with other vibratory and non-vibratory mechanical functions.

An "accessory" or "accessories" as used herein and throughout this disclosure may refer to, but is not limited to, one or more objects that can be affixed to or otherwise appended to the body of a sexual pleasure device in order to enhance and/or adjust the sensation(s) provided. Such accessories can be passive, such as nubbies, fronds, fingers, finger, dildo, etc. or they may be active, such as a vibrator(s), electrode(s), hydraulically actuated structures, etc.

A "profile" as used herein and throughout this disclosure may refer to, but is not limited to, a computer and/or microprocessor readable data file comprising data relating to settings and/or limits of an adult device. Such profiles may be established by a manufacturer of the adult device or established by an individual through a user interface to the adult device or a portable electronic device (PED)/fixed electronic device (FED) in communication with the adult device.

A "vibrator" as used herein and throughout this disclosure may refer to, but is not limited to, an electronic sexual pleasure device intended for use by an individual or user themselves or in conjunction with activities with another individual or user wherein the vibrator provides a vibratory mechanical function for stimulating nerves or triggering physical sensations.

A "dildo" as used herein and throughout this disclosure may refer to, but is not limited to, sexual pleasure device intended for use by an individual or user themselves or in conjunction with activities with another individual or user wherein the dildo provides non-vibratory mechanical function for stimulating nerves or triggering physical sensations.

A "nubby" or "nubbies" as used herein and throughout this disclosure may refer to, but is not limited to, projection or projections upon the surface of a sexual pleasure device intended to provide additional physical interaction. A nubby can be permanently part of the sexual pleasure device or it can be replaceable or interchangeable to provide additional variation to the sexual pleasure device.

A "scaffold" or "scaffolds" as used herein and throughout this disclosure may refer to, but is not limited to, structure that is used to hold up, interface with, or support another material or element(s). This includes, but is not limited to, such two-dimensional (2D) structures such as substrates and films, three-dimensional (3D) structures such as geometrical objects, non-geometrical objects, combinations of geometrical and non-geometrical objects, naturally occurring structural configurations, and manmade structural configurations. A scaffold may be solid, hollow, and porous or a combination thereof. A scaffold may contain recesses, pores, openings, holes, vias, and channels or a combination thereof. A scaffold may be smooth, textured, have predetermined surface profiles and/or features. A scaffold may be intended to support one or more other materials, one or more films, a multilayer film, one type of particle, multiple types of particles etc. A scaffold may include, but not be limited to, a spine of a device and/or a framework, for example, which also supports a shell and/or a casing.

A "shell" as used herein and throughout this disclosure may refer to, but is not limited to, structure that is used to contain and/or surround at least partially and/or fully a number of elements within adult devices according to embodiments of the invention. A shell may include, but not limited to, a part or parts that are mounted to a scaffold or scaffolds that support elements within a device according to an embodiment of the invention.

A "casing" as used herein and throughout this disclosure may refer to, but is not limited to, a structure surrounding a scaffold and/or shell. This includes structures typically formed from an elastomer and/or silicone to provide a desired combination of physical tactile surface properties to the device it forms part of and other properties including, but not limited to, hermeticity, liquid ingress barrier, solid particulate ingress barrier, surface sheen, and colour. A casing may include, but not limited to, a part or parts that are mounted to a scaffold or scaffolds and/or a casing or casings forming part of a device according to an embodiment of the invention.

An "electric motor" or "motor" as used herein and throughout this disclosure may refer to, but is not limited to, a category of providers of motive means characterised by a periodic movement of a shaft or drive shaft connected to the motor which is powered by electricity. Such motors include DC and AC motors. This includes, but is not limited to, brushed DC motors, permanent magnet DC motors, brushless DC motors, switched reluctance motors, universal AC-DC motors, induction motors, ironless or coreless rotor motors, pancake or axial rotor motors, stepper motors, piezoelectric motors and linear motors.

A "bearing" as used herein and throughout this disclosure may refer to, but is not limited to, a machine element or element that constrains relative motion to only the desired motion, and reduces friction between moving parts. The design of the bearing may, for example, provide for free linear movement of the moving part or for free rotation around a fixed axis; or, it may prevent a motion by controlling the vectors of normal forces that bear on the moving part(s). Most bearings facilitate the desired motion by minimizing friction and are classified broadly according to the type of operation, the motions allowed, or to the directions of the loads (forces) applied to the parts. Rotary bearings hold rotating components within mechanical systems, and transfer axial and radial loads from the source of the load to the structure supporting it. In a ball bearing or roller bearing, to prevent sliding friction, rolling elements such as rollers or balls with a circular cross-section are located between the races or journals of the bearing assembly. A wide variety of bearing designs exists to allow the demands of the application to be correctly met for maximum efficiency, reliability, durability and performance. Reducing friction in bearings is often important for efficiency, to reduce wear and to facilitate extended use (especially at high speeds or long projected product lifespan) and to avoid overheating and/or premature failure of the bearing. Essentially, a bearing can reduce friction by virtue of its shape, by its material, or by introducing and containing a fluid between surfaces or by separating the surfaces with an electromagnetic field. Accordingly:

- By shape, a bearing gains advantage usually by using spheres or rollers to minimize the contact surface(s);
- By material, a bearing exploits the nature of the bearing material used, such as a plastic having low surface friction for example;
- By fluid, a bearing exploits the low viscosity of a layer of fluid, such as a lubricant or as a pressurized medium to keep the two solid parts from touching, or by reducing the normal force between them; and
- By fields, a bearing exploits electromagnetic fields, such as magnetic fields, to keep solid parts from touching.

A "rotary electric motor" as used herein and throughout this disclosure refers to, but is not limited to, an electric motor that converts electrical energy into mechanical energy resulting in rotary motion around an axis of the electric motor in contrast to a linear electromagnetic motor that converts electrical energy in linear mechanical motion. Rotary electric motors achieve this through an interaction between an electric motor's magnetic field and winding currents to generate force. The main elements of a rotary electric motor being:

- Rotor, refers generally to the moving part of the motor that delivers mechanical power and usually has conductors laid into it that carry currents which interact with the magnetic field of the stator to generate the forces that turn the shaft.

Bearings, these support the rotor allowing it to turn and are in turn supported by the motor housing and within motors with shafts the shaft extends through the bearings for attachment to the load whilst within a hollow motor this shaft is omitted.

Stator, refers generally to the stationary part of the motor's electromagnetic circuit and usually consists of windings or permanent magnets where the stator core is typically made up of many thin metal sheets, called laminations, in order to reduce energy losses.

Air gap, being the gap between rotor and stator which has important effects, and is generally as small as possible, as a large gap has a strong negative effect on the performance of an electric motor and increases the magnetizing current needed but very small gaps may pose mechanical problems in addition to noise and losses.

Windings, refers to the wires that are laid in coils, usually wrapped around a laminated soft iron magnetic core so as to form magnetic poles when energized with current.

Commutator, which provides the mechanism used to switch the input of most DC machines and certain AC machines and typically consists of slip ring segments insulated from each other. The motor's armature current is supplied through the stationary brushes in contact with the revolving commutator, which causes required current reversal and applies power to the machine in an optimal manner as the rotor rotates from pole to pole.

"Polyester" as used herein and throughout this disclosure may refer to, but is not limited to, category of polymers that contain the ester functional group in their main chain. This includes, but is not limited to polyesters which are naturally occurring chemicals as well as synthetics through step-growth polymerization, for example. Polyesters may be biodegradable or not. Polyesters may be a thermoplastic or thermoset or resins cured by hardeners. Polyesters may be aliphatic, semi-aromatic or aromatic. Polyesters may include, but not be limited to, those exploiting polyglycolide, polylactic acid (PLA), polycaprolactone (PCL), polyhydroxyalkanoate (PHA), polyhydroxybutyrate (PHB), polyethylene adipate (PEA), polybutylene succinate (PBS), polyethylene terephthalate (PET), polybutylene terephthalate (PBT), polytrimethylene terephthalate (PTT), and polyethylene naphthalate (PEN).

A "thermoplastic" or "thermosoftening plastic" as used herein and throughout this disclosure, refers to a category of polymers that become pliable or moldable above a specific temperature and solidify upon cooling. Thermoplastics may include, but not be limited, polycarbonate (PC), polyether sulfone (PES), polyether ether ketone (PEEK), polyethylene (PE), polypropylene (PP), poly vinyl chloride (PVC), polytetrafluoroethylene (PTFE), polyimide (PI), polyphenylsulfone (PPSU), polychlorotrifluoroethene (PCTFE or PTFCE), florinated ethylene propylene (FEP), and perfluoroalkoxy alkane (PFA).

A "metal" as used herein and throughout this disclosure may refer to, but is not limited to, material that has good electrical and thermal conductivity. Such materials may be malleable and/or fusible and/or ductile. Metals may include, but not be limited to, aluminum, nickel, copper, cobalt, chromium, silver, gold, platinum, iron, zinc, titanium, and alloys thereof such as bronze, stainless steel, stainless stainless steel, brass, and phosphor bronze.

An "aramid" as used herein, and throughout this disclosure, refers to an aromatic polyamide. Aramids are a class of materials fibers in which the chain molecules are highly oriented along the fiber axis, so the strength of the chemical bond can be exploited. Examples, include, but are not limited to fibers distributed under brand names such as Kevlar™ Technora™, Twaron™, Heracron™, Nomex™, Innegra S™ and Vectran™ as well as nylon and ultra-high molecular weight polyethylene.

A "silicone" as used herein and throughout this disclosure may refer to, but is not limited to, polymer that includes any inert, synthetic compound made up of repeating units of siloxane.

An "elastomeric" material or "elastomer" as used herein and throughout this disclosure may refer to, but is not limited to, material, generally a polymer, with viscoelasticity. Elastomers may include, but not be limited to, unsaturated rubbers such as polyisoprene, butyl rubber, ethylene propylene rubber, silicone rubber, fluorosilicone rubber, fluoroelastomers, perfluoroelastomers, and thermoplastic elastomers.

The terms "woman" or "female" as used herein and throughout this disclosure may refer to, but is not limited to, human having a clitoris or clitoral region and, optionally, a vagina and/or an anus. The terms "woman" and "female" are used interchangeably herein. A female may be a user, an individual, another user, and/or another individual within contexts of the specification.

The terms "man" or "male" as used herein and throughout this disclosure may refer to, but is not limited to, human having a penis and, optionally, testes and/or an anus. The terms "man" and "male" are used interchangeably herein. A male may be a user, an individual, another user, and/or another individual within contexts of the specification.

The term "flexible," as used herein, refers to the ability of a body that is capable of being bent or flexed. Something that is flexible can be, for example, resilient or malleable. The term "resilient," as used herein, refers to the ability of a body that has been subjected to an external force to recover, or substantially recover, its original size and/or shape, following deformation. The term "malleable," as used herein, refers to the ability of a body that has been subjected to an external force to deform and maintain, or substantially maintain, the deformed size and/or shape. The term "flexible," as used herein, refers to the ability of a body that has been subjected to an external force to return to its original size and/or shape once the external force has been removed or reduced to below a particular level.

As used herein, the terms "sex", "intercourse", "sexual intercourse" are intended to have a meaning referring to an act or action between two users wherein part of the act or action relates to the stimulation of one user's or both user's clitoris and/or clitoral region. Such acts or actions may or may not involve the concurrent penetration of a user's vagina, anus, or mouth and may be male-female, female-female, and solitary female based acts or actions.

The term "elastic" as used herein, refers to or may describe or identify certain types of elastomer and/or stretchable fabrics or it may refer to the ability of a body to resist a distorting influence or stress and to return to its original size and shape when the stress is removed. Whilst solid objects will deform when sufficient force is applied a material is considered elastic and will return to its initial shape and size when the force is removed.

The term "resilient" as used herein, refers either to a material having the ability to absorb energy when it is deformed elastically, and release that energy upon unloading or to a material having the ability to resist deformation under pressure. Embodiments of the invention may employ, for example, a plastic inner ring and/or liner within which a portion of a user is inserted, e.g. a penis, finger, wrist, etc. which supports limited deformation around which a hollow shaft motor may be employed to impart vibratory action discretely or in combination with one or more other actuators such as fluidic actuators and/or linear electrical actuators etc. The fluidic actuators may employ one or more elastic and/or elastomeric materials. Alternatively, the inner ring and/or liner may be elastic but having a higher Young's modulus that another elastic material employed within a fluidic actuator for example.

Within embodiments of the invention described below and as depicted with respect to FIGS. 1A to 9 the primary deployments, configurations, and use cases discussed are directed to sex toys/adult devices. However, it would be evident to one of skill in the art that the embodiments of the invention may be equally applied to other devices including, but not limited to, medical devices and/or therapeutic devices. Accordingly, the scope of the invention should be read as being broadly within the fields of medical devices, therapeutic devices, and recreational devices.

Further, within FIGS. 1A to 9 and their associated descriptions within the specification such medical devices, therapeutic devices, and recreational devices may be considered to have been described from the primary viewpoint of wearable devices. However, it would be evident to one of skill in the art that such devices may also be part of portable devices and/or fixed devices.

Within embodiments of the invention described below and as depicted with respect to FIGS. 1A to 9 some elements are depicted in simplified form. Accordingly, for example an Electromagnetic Piston Actuator (EMPA) may be depicted as comprising a controller, a piston assembly housing, piston magnet, and electromagnet. However, features including, but not limited to, inner sleeves within which the piston magnet slides, multiple coils, additional washers, additional magnets, etc. are not depicted as any appropriately designed EMPA may be employed. Similarly, in respect of a hollow shaft motor then this is depicted in simplified form wherein details relating to the construction of the rotor, stator, windings, permanent magnets etc. are not depicted. However, it would be evident to one of skill in the art that an appropriate hollow shaft motor selected from the available designs including, but not limited to, those in FIG. 1B. Further, whilst embodiments of the invention may be described with a fixed outer element and rotating inner element or vice-versa it would be evident to one skilled in the art that the reverse may be employed according to the design boundaries and/or requirements. For example, a device intended to stimulate a wrist wherein the user inserts their hand through the hollow motor may employ a rotating inner element whereas a device intended to be worn by a first user upon a first predetermined portion of their body and stimulate either another user or a second predetermined portion of their body may employ a rotating outer element.

FIG. 1A depicts a classification tree 100 for Hollow Shaft devices 110 employing Hydraulic Motors 120 or Electrical Motors 130. Hydraulic Motors 120 may be sub-divided into Hydraulic Families 1100 comprising Linear 1110, Oscillating 1120, and Rotary 1130 respectively. Similarly, Electrical Motors 130 can be sub-divided into Rotary 130A and Linear 130B each of which may be further sub-divided into Rotary Electrical Families 1200 and Linear Electrical Families 1300. Rotary Electrical Family 1200 is depicted and described below with respect to FIG. 1B. Linear Electrical Family 1300 may be Linear Translation 1310 and Linear Oscillating 1320, for example. Linear Translation 1310, also referred to as a Z-axis linear resonant motor, exploits a magnetic mass which is actuated under action of an electrical coil where the magnetic mass slides within a guide rail. Linear Oscillating 1320, also referred to as a Y-axis linear resonant motor, exploits a magnetic mass is actuated under action of an electrical coil.

As noted above devices are available in a wide range of geometries and functionalities exploiting solid device bodies that contain the vibrating element, battery, control electronics etc. within a scaffold, usually plastic, which is encased within a shell, usually silicone, wherein the device body may be inserted into a user to provide sexual stimulation. In contrast, embodiments of the invention are intended to be worn by a user whilst engaging in sexually stimulating or arousing/massaging another user or themselves. For example, as described below adult devices (ADDEVs) may be worn by a male user wherein the ADDEV is around a portion of their penis during penetrative sex with another partner or may be worn around a strap-on dildo used by a female user with another partner or themselves. Accordingly, the ADDEV now may have a scaffold that is annular with a hollow shaft for example.

Figure 1B:
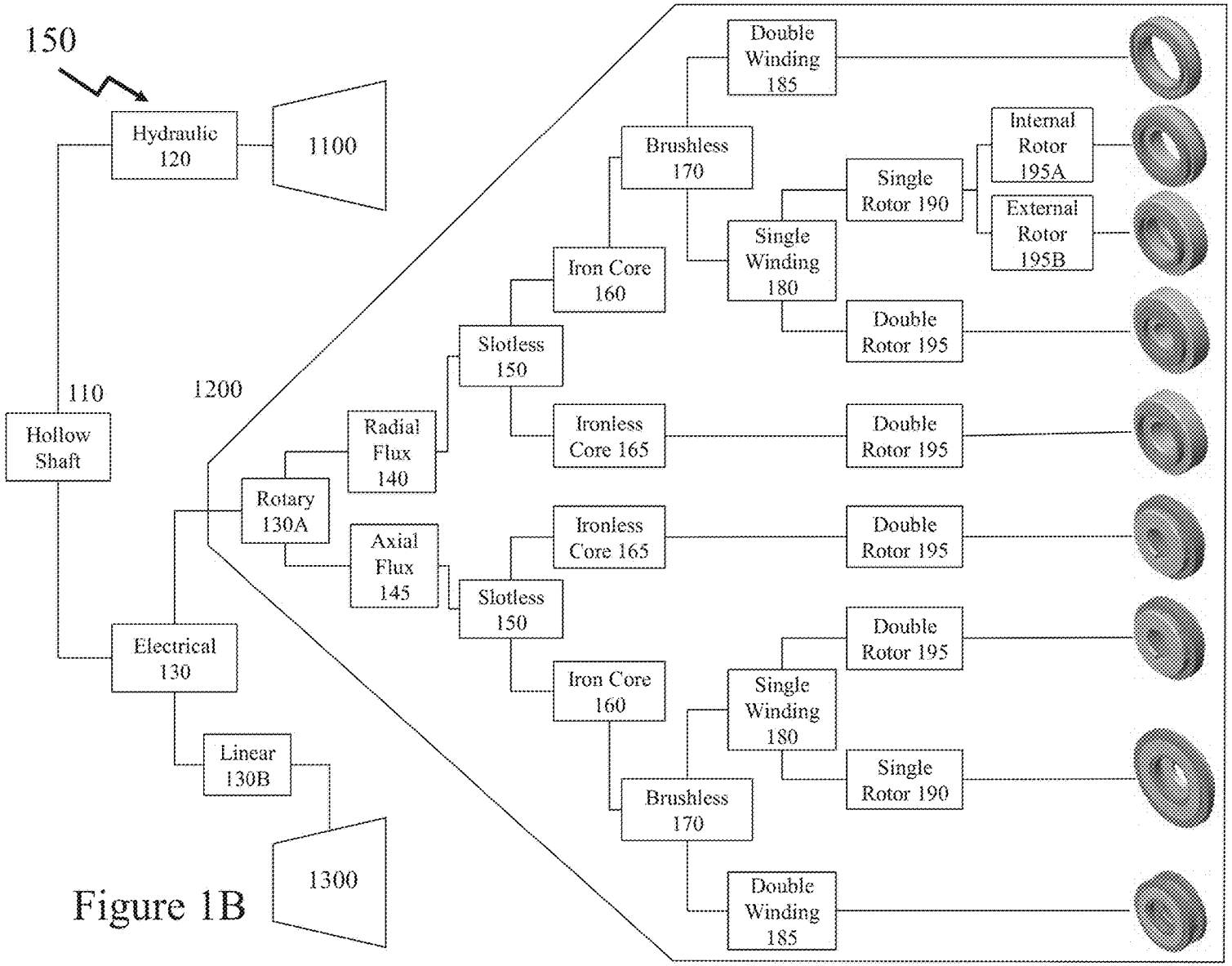
FIG. 1B depicts a classification tree for hollow shaft devices employing rotary electrical actuation means according to embodiments of the invention.

As noted above in respect of FIG. 1A a classification tree 100 was depicted in respect of families of actuators for hollow shaft devices. One family, Rotary Electrical Family 1200, is depicted in FIG. 1B with a classification tree 150 wherein Rotary 130A sub-division of Electrical Motors 130 is depicted for hollow shaft devices employing rotary electrical actuation means according to embodiments of the invention. As depicted Rotary Electrical Family 1200 defines a hierarchy of levels of rotary electrical motors with hollow shafts wherein the hierarchy of levels are defined in Table 1 below.

TABLE 1

Hierarchy of Rotary Electrical Motors

| Hierarchy | Design Aspect | | Motor Family |
|---|---|---|---|
| 0 | Rotary Motor | | Rotary 130A |
| 1 | Flux | Radial | Radial Flux 140 |
| | | Linear | Linear Flux 145 |
| 2 | Winding Design | Slotted | (Not Depicted) |
| | | Slotless | Slotless 150 |
| 3 | Core | Iron | Iron Core 160 |
| | | Ironless | Ironless Core 165 |
| 4 | Brush | Brushed | (Not Depicted) |
| | | Brushless | Brushless 170 |
| 5 | Winding | Single | Singles Winding 180 |
| | | Double | Double Winding 185 |
| 6 | Rotor | Single | Single Rotor 190 |
| | | Double | Double Rotor 190 |
| 7 | Rotor Position | Internal | Internal Rotor 195A |
| | | External | External Rotor 195B |

Figure 2B:
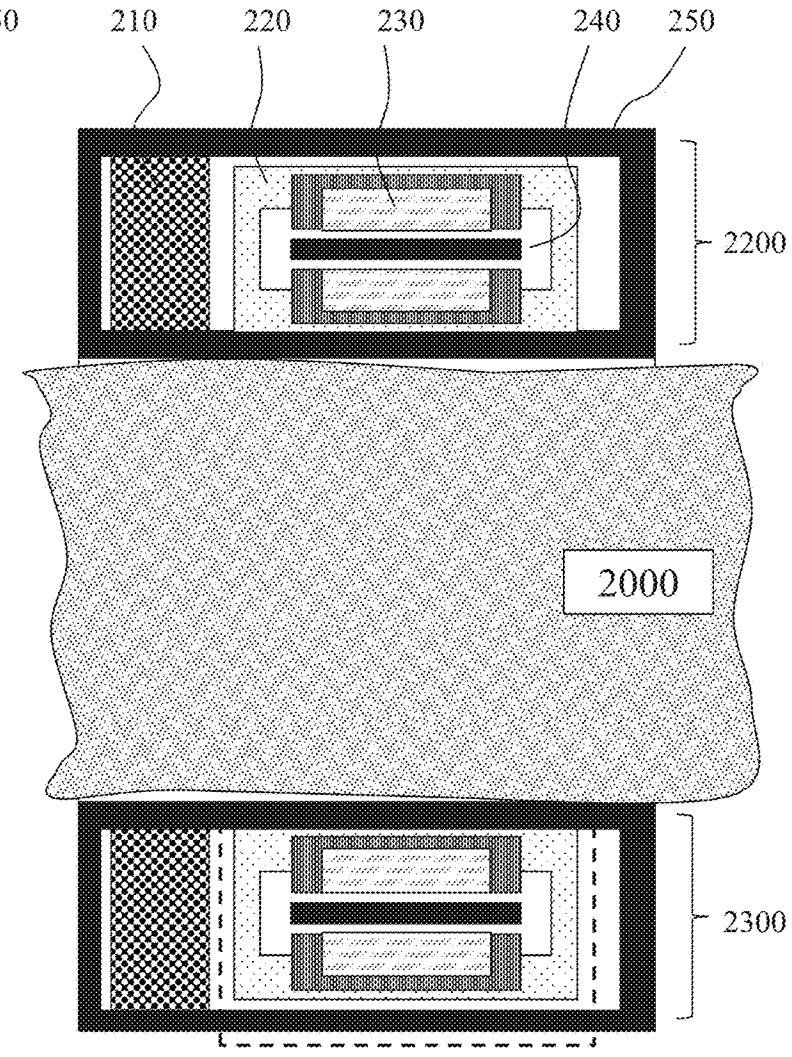
FIGS. 2A and 2B depict longitudinal cross-sections along the supporting body portion of hollow shaft devices according to embodiments of the invention exploiting electromagnetic piston actuators.
Figure 2A:
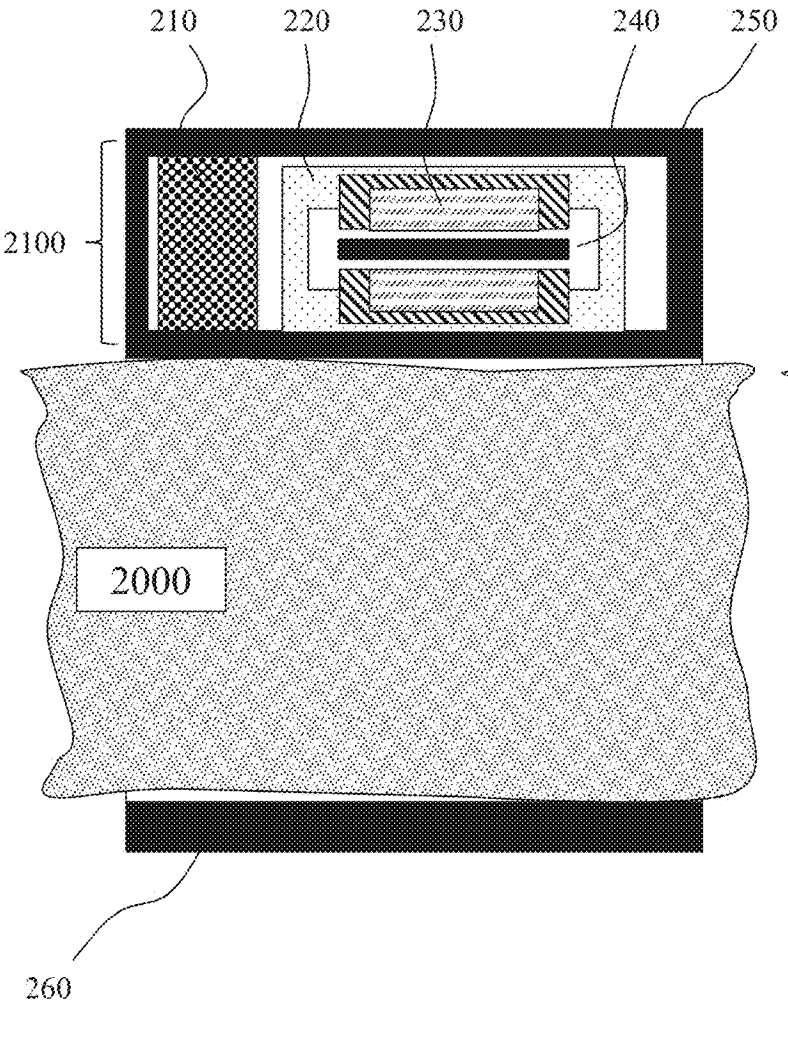

Now referring to FIGS. 2A and 2B there are depicted longitudinal cross-sections along the supporting body portion of hollow shaft devices according to embodiments of the invention exploiting electromagnetic piston actuators, e.g. an electrical "motor" that can provide both Linear Translation 1310 and Linear Oscillating 1320 motors according to the design of the electromagnetic piston actuator and the electrical drive signal provided from the control circuit or microprocessor based controller. As depicted in FIG. 2A a single Electromagnetic Piston Actuator (EMPA) 2100 is attached to a member 2000 via a band 260 which may, for example, be rigid, semi-rigid, or flexible. A flexible band or semi-rigid band may be formed from an elastic material for ease of placement/attachment as well as allowing a single design to accommodate a range of dimensions for the diameter/cross-section of the member 2000. EMPA 2100 comprises an outer casing 250 within which are controller 210, piston assembly housing 220, piston magnet 240 and electromagnet 230. Under control of the controller 210 electrical drive signals to the electromagnet 230 result in varying magnetic field being generated which drives the piston magnet 240 within the outer casing 250. In contrast in FIG. 2A first and second EMPA 2200 and 2300 are depicted disposed on opposite sides of the member 2200.

Figure 2D:
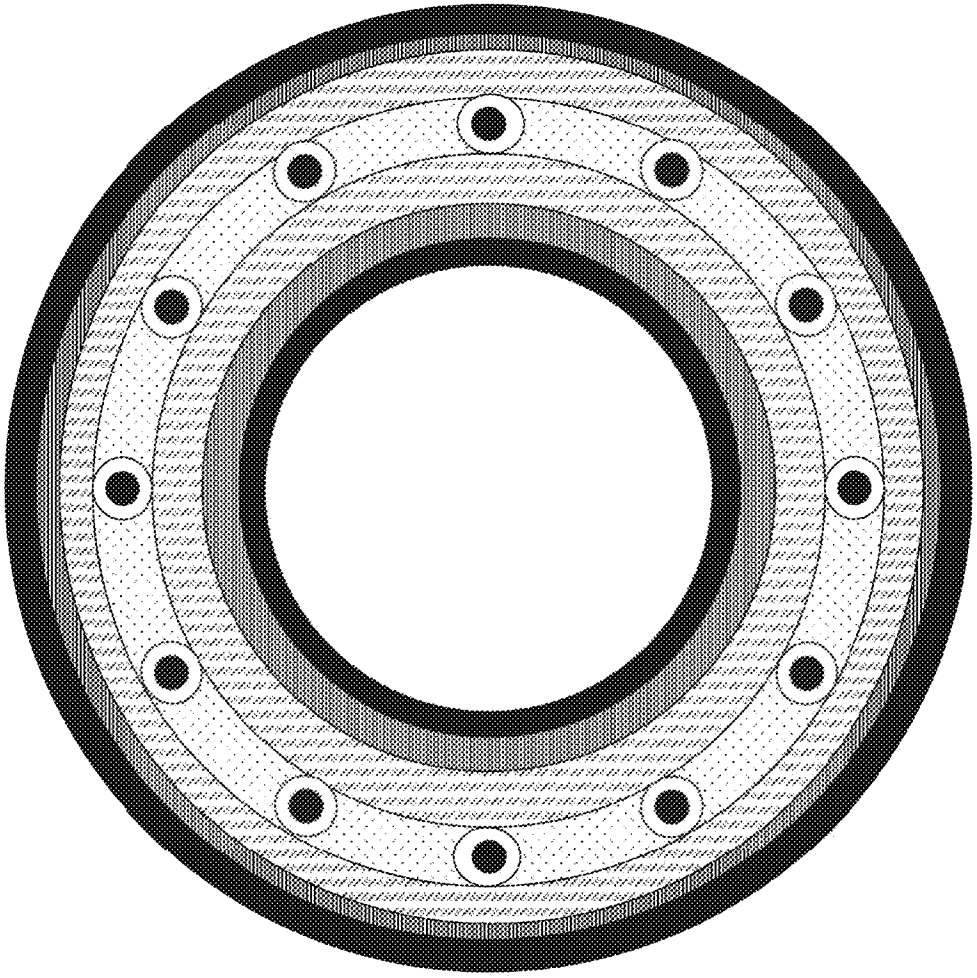
FIGS. 2C to 2F depict lateral cross-sections through the supporting body portion of hollow shaft devices according to embodiments of the invention exploiting electromagnetic piston actuators.
Figure 2C:
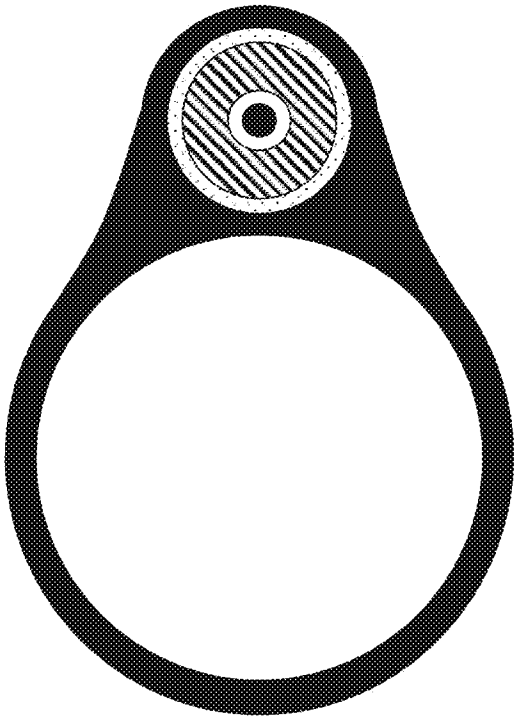
Figure 2F:
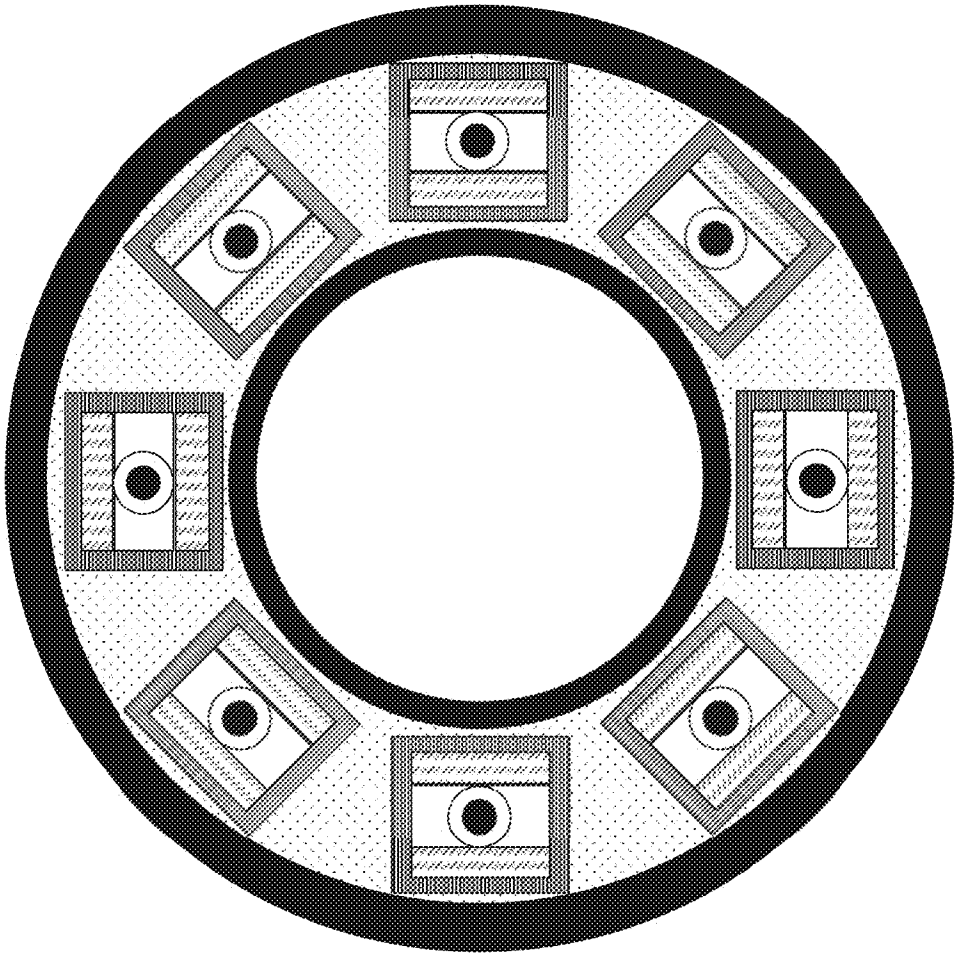
Figure 2E:
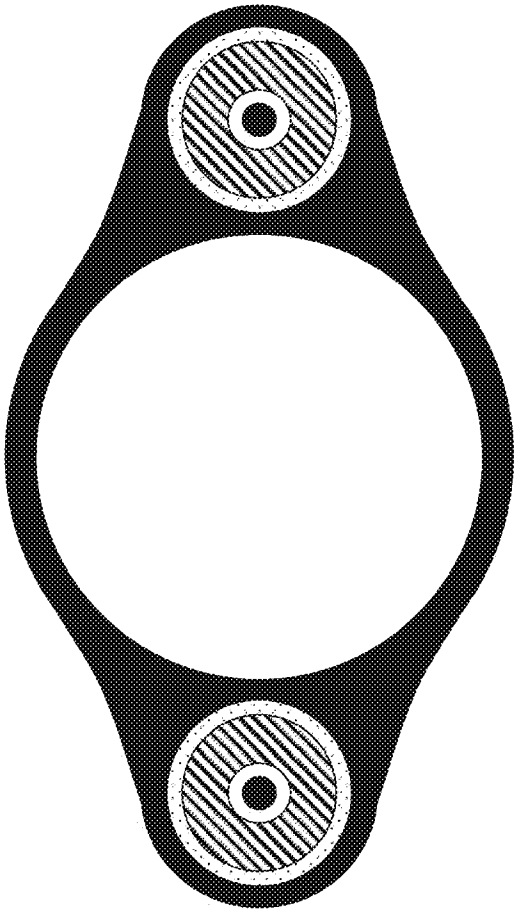

This concept is expanded in FIGS. 2C to 2F wherein there are depicted lateral cross-sections through the supporting body portion of hollow shaft devices according to embodiments of the invention exploiting electromagnetic piston actuators. Accordingly, FIG. 2C depicts a transverse cross-section of a single EMPA device such as depicted in FIG. 2A with its longitudinal cross-section whilst FIG. 2D depicts a transverse cross-section of a multiple EMPA device such as depicted in FIG. 2B. However, as evident in FIG. 2D the device employs 12 pistons wherein, if we define pistons moving in the same direction together as in-phase and opposite directions as out-of-phase, these 12 pistons allow for a variety of control patterns to be employed including all in-phase, left/right out-of-phase, top/bottom out-of-phase, radially pulsing, etc. Similarly, FIGS. 2E and 2F depict transverse cross-sections of devices employing linear piston elements such as depicted longitudinally in FIG. 2D. FIG. 2E depicts a dual EMPA device whilst FIG. 2F depicts an 8 piston configuration wherein rather than continuous rings of windings, etc. discrete sub-assemblies are embedded in a filler.

Figure 3A:
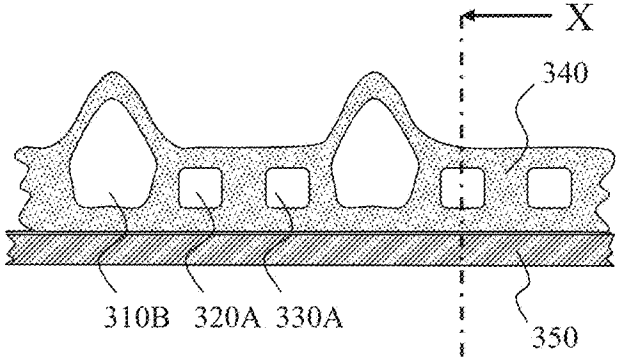
FIGS. 3A to 3C depict longitudinal cross-sections along the supporting body portion of hollow shaft devices according to embodiments of the invention exploiting fluidic actuators.
Figure 3B:
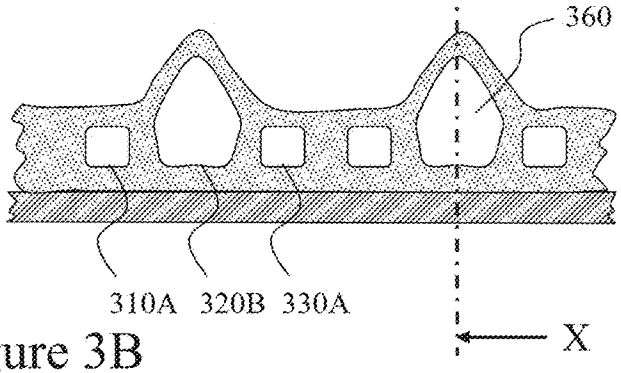
Figure 3C:
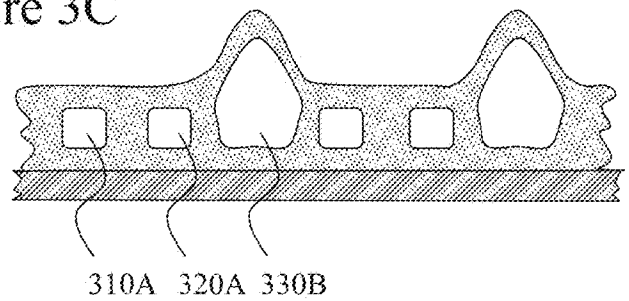

FIGS. 3A to 3C depict longitudinal cross-sections along the supporting body portion of hollow shaft devices according to embodiments of the invention exploiting fluidic actuators. Referring to FIGS. 3A to 3C respectively a fluidic actuator based evolving location pressure element is depicted in its first to third states. The fluidic actuator based evolving location pressure elements comprise a plurality of fluidic chambers are disposed within an elastic layer 340 disposed above a resilient layer 350 in a repeating pattern of 3 elements. Accordingly, inflation of the fluidic chambers results in expansion locally due to the thinning of the elastic layer 340 in conjunction with the resilient layer 350. Accordingly, as depicted in FIGS. 3A through 3C the first to third fluidic chambers 310 through 330 respectively are cycled between compressed state "A" and expanded state "B" such that overall the user feels a pressure moving along the length of the sexual pleasure device. While only two repeats of the sequence of first to third fluidic chambers 310 through 330, respectively, are depicted it would be evident to one skilled in the art that one, two, three or more sets can be employed in sequence as well as in multiple positions on the sexual pleasure device.

Figure 3D:
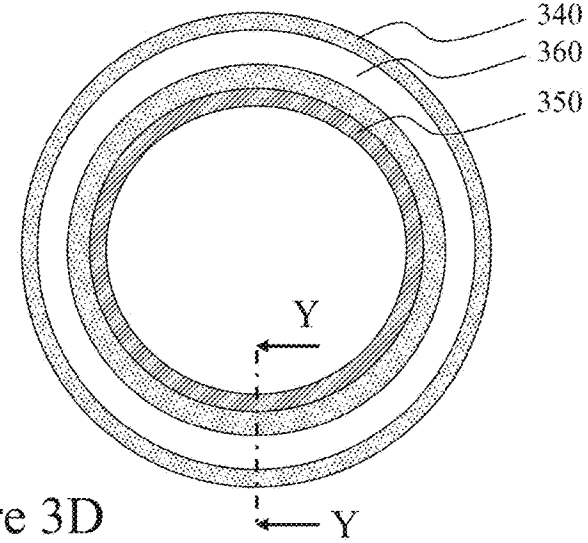
FIGS. 3D and 3E depict lateral cross-sections through the supporting body portion of hollow shaft devices of FIGS. 3A to 3C according to embodiments of the invention exploiting fluidic actuators.
Figure 3E:
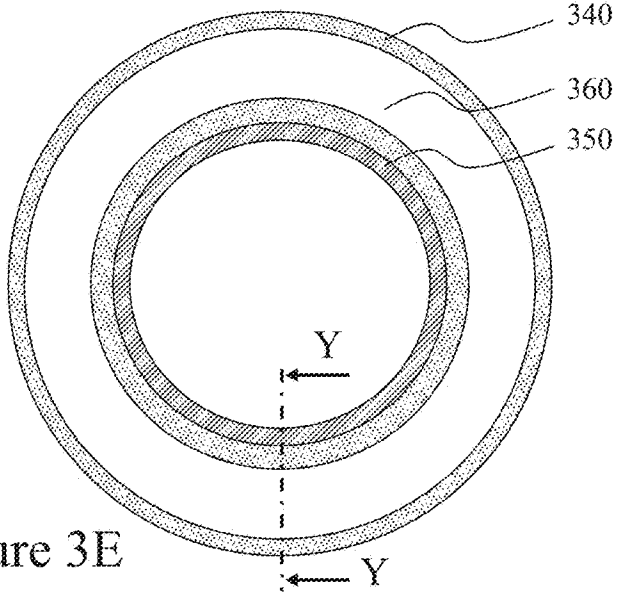

Now referring to FIGS. 3D and 3E these depict lateral (transverse) cross-sections through the supporting body portion of hollow shaft devices of FIGS. 3A to 3C according to embodiments of the invention exploiting fluidic actuators which are depicted as longitudinal cross-sections. Accordingly, FIG. 3D depicts a cross-section through a fluidic chamber in compressed state "A" whilst FIG. 3E depicts a cross-section through a fluidic chamber in expanded state "B." Accordingly, an inner resilient ring 350 is depicted with an annular ring of elastic layer 340 within which a fluidic chamber filled with fluid 360 is depicted in each.

Figure 3F:
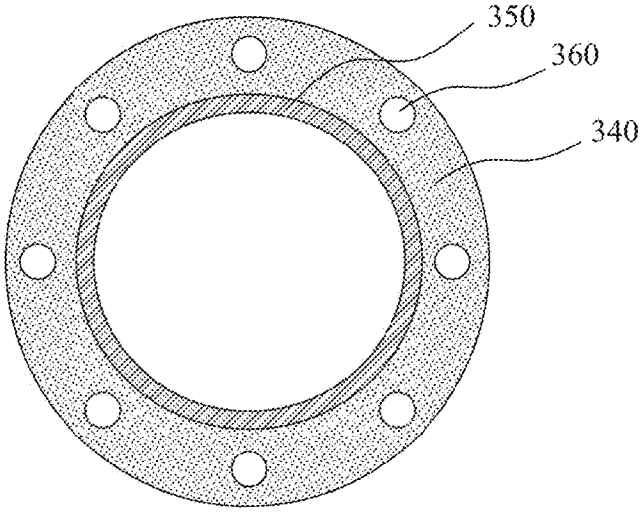
Figure 3G:
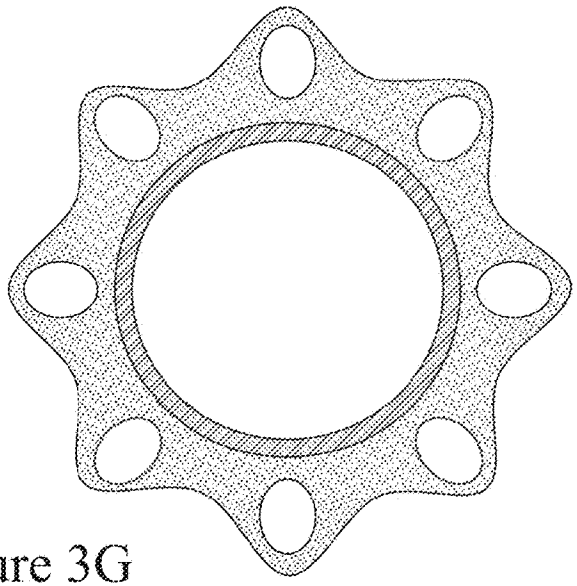
Figure 3H:
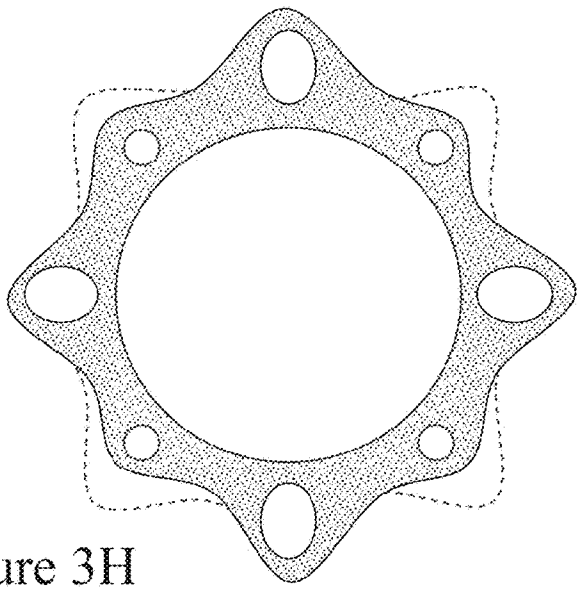
Figure 3I:
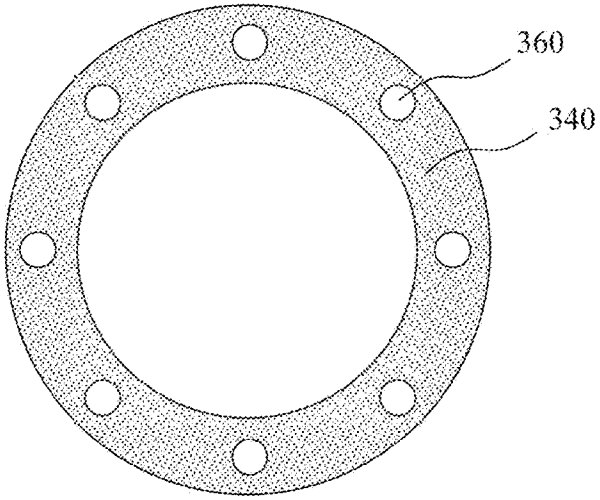

Now referring to FIGS. 3F to 31 there are depicted lateral cross-sections through the supporting body portion of hollow shaft devices according to embodiments of the invention exploiting fluidic actuators such as described and depicted in respect of FIGS. 3A to 3C respectively. In FIG. 3F the fluidic chambers 360 within the elastic layer 340 around a resilient layer 350 are depicted in unexpanded state whilst in FIGS. 3G and 3H two different active configurations are shown with all and alternating chambers expanded. It would be evident that through a combination of multiple radial and multiple longitudinal fluidic chambers a wide range of pressure sensations to the user may be established such as radially varying, longitudinally varying, or spiraling through a concurrent combination of radial and longitudinal variations.

Whilst FIGS. 3A to 31 depict fluidic actuator based pressure elements FIGS. 4A to 4D respectively depict fluidic actuator based surface friction elements according to an embodiment of the invention. Such an element is depicted in first to third states in FIGS. 4A to 4C respectively. As depicted in FIGS. 4A to 4C the fluidic actuator based surface friction element comprises an upper layer 440 upon which are disposed first projections 450 defining a recess there between on the lower surface of the upper layer 440. Disposed below and spaced apart from upper layer 440 is flexible layer 460, which has on its upper surface a second projection 430, which extends into the recess formed between a pair of first projections 450 and is positioned between the pair of first projections 450. Disposed to the left of second projection 430 between flexible layer 460 and upper layer 440 is first fluidic chamber 410 whilst to the right of second projection 430 between the flexible layer 460 and upper layer 440 is second fluidic chamber 420. As depicted in first state in FIG. 4A the first and second fluidic chambers 410 and 420, respectively, have approximately the same dimensions such that the flexible layer 460 is defined as having first left and right regions 460A and 460B respectively which are similar as evident from the lower contour profile of the textured surface of the flexible layer 460.

Now referring to second state in FIG. 4B the right fluidic chamber has expanded to become expanded right fluidic chamber 424 whilst the left fluidic chamber has reduced to become reduced left fluidic chamber 414. Accordingly, the resulting motion of the second projection 430 results in the flexible layer now being defined by second left and right regions 460C and 460D respectively wherein the textured surface now differs to the left and right. Now referring to third state in FIG. 4C the left fluidic chamber has expanded to become expanded left fluidic chamber 418 whilst the right fluidic chamber has reduced to become reduced right fluidic chamber 428. Each fluidic chamber is depicted in a compressed state "A" or expanded state "B" but it would be evident that any intermediate position may be obtained through appropriate control of the fluidic system driving the actuators. Accordingly, the resulting motion of the second projection 430 results in the flexible layer now being defined by third left and right regions 460E and 460F respectively wherein the textured surface now differs to the left and right. Accordingly, based upon the overall design of the fluidic actuation system coupled to the left and right fluidic chambers within the sexual pleasure device of which the fluidic actuator based surface friction element forms part then fluid can be pumped into and out of the first and second fluidic chambers 410 and 420 in a predetermined manner such that the lower surface of the elastic layer 460 moves back and forth wherein when placed against the user's skin the motion in combination with the surface texture of the elastic layer 460 causes friction thereby imparting sensations according to the region of the user the elastic layer 460 contacts. It would be evident that first projections 450 and upper layer 440 can be formed from the same single piece-part as can second projection 430 and elastic layer 460. In contrast to mechanical coupled systems it would be evident that fluidic systems allow for user manual manipulation of the sexual pleasure device shape to be easily accomplished/accommodated without significant additional complexity by provisioning flexible or semi-flexible tubing in such regions rather than complex mechanical joints etc.

Figure 4F:
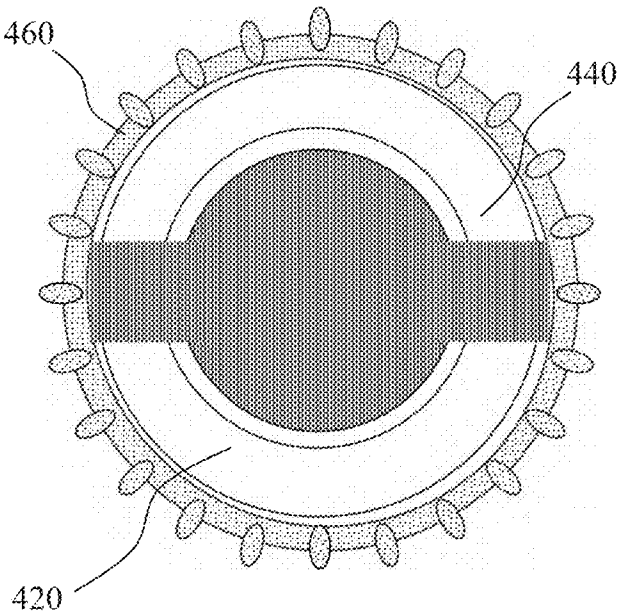
Figure 4E:
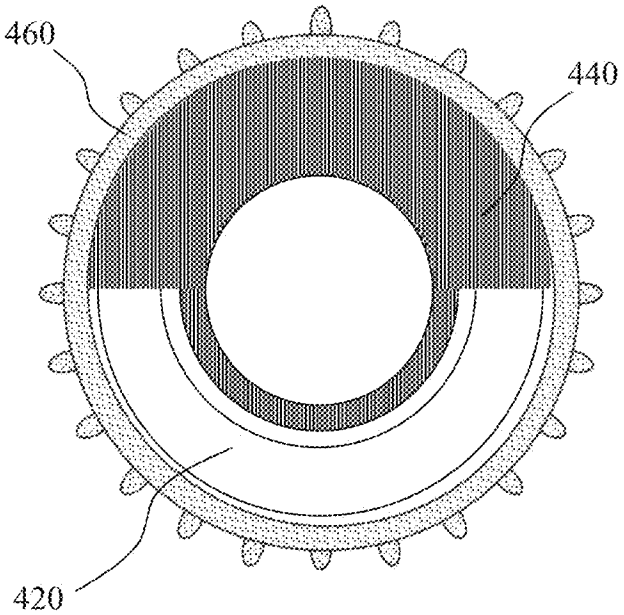

FIG. 4D depicts a lateral cross-section through the supporting body portion of hollow shaft devices of FIGS. 4A to 4C according to embodiments of the invention exploiting fluidic actuators wherein the inner ring of the device is formed by upper layer 440, the outer shell of the device is formed by elastic layer 460 and the inner fluidic chamber 420. Now referring to FIGS. 4E and 4F there are depicted lateral cross-sections of variants wherein the fluidic actuator is disposed on one side of the hollow shaft device or two independent fluidic actuators are disposed on opposite sides. It would be evident that within other embodiments of the invention that the number of fluidic actuators radially disposed may be varied to be 1, 2, 3, 4, 5, 6, 8, etc. or that the number and location of the actuators may vary along the length of the device according to the device, it's intended function, etc.

Figure 5B:
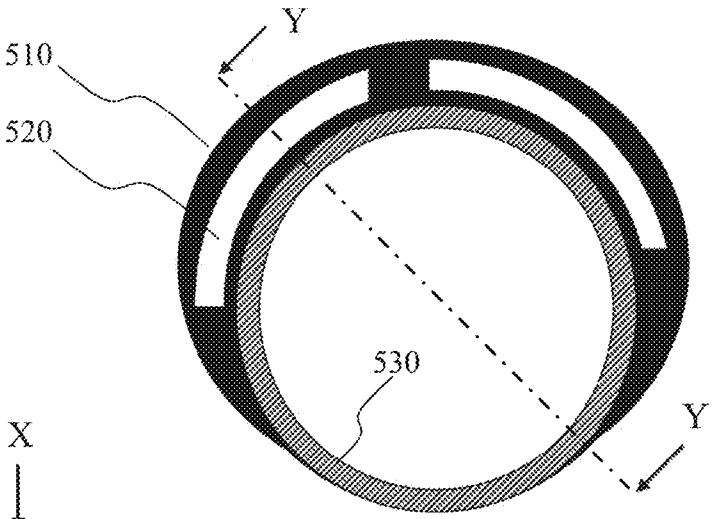
FIGS. 5B and 5C depict lateral cross-sections through the supporting body portion of hollow shaft devices of FIG. 5A according to embodiments of the invention exploiting fluidic actuators.
Figure 5C:
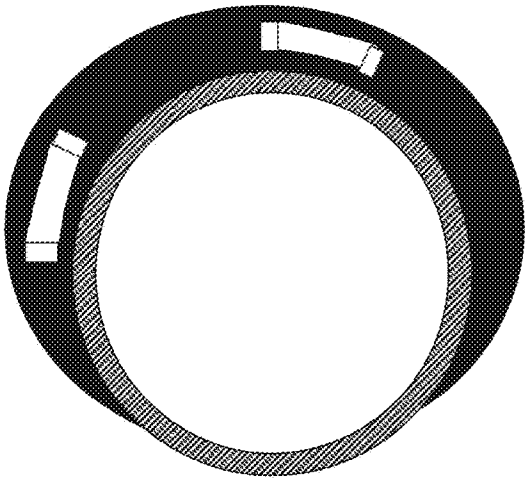
Figure 5A:
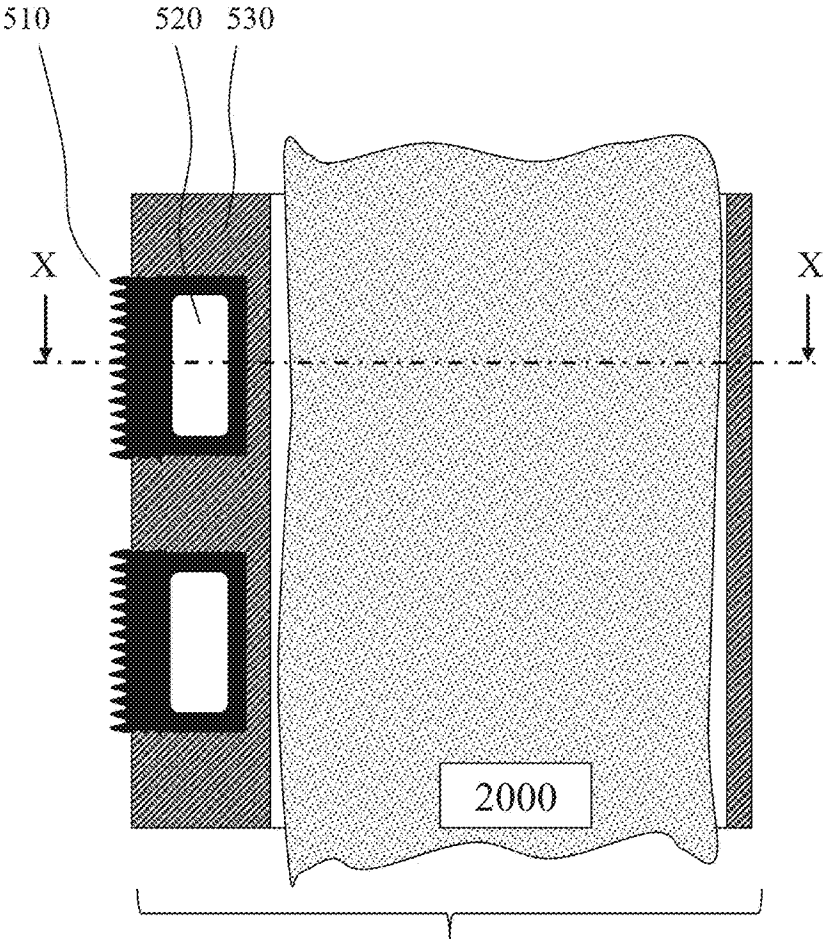
FIG. 5A depicts a longitudinal cross-section along the supporting body portion of a hollow shaft device according to embodiments of the invention exploiting fluidic actuators.

Now referring to FIG. 5A there is depicted a longitudinal cross-section along the supporting body portion of a hollow shaft device according to embodiments of the invention exploiting fluidic actuators wherein the member 2000 has a ring attached of resilient material 530 within which are fluidic actuators comprising fluidic chamber 520 and body of elastic material 510. As depicted in FIGS. 5B and 5C which depict lateral cross-sections through the supporting body portion of hollow shaft device of FIG. 5A, which depicts a longitudinal cross-section, according to embodiments of the invention the ring resilient material 530 has elastic material 510 disposed asymmetrically wherein in FIGS. 5B and 5C the fluidic chambers are depicted in expanded and compressed states respectively. Optionally, fluidic chambers may be sequenced out of phase, partially out of phase etc. or expand in opposite directions etc.

Figure 5E:
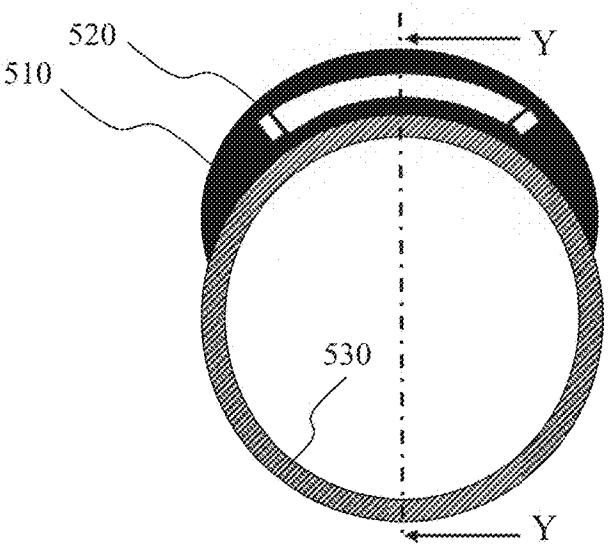
FIGS. 5E and 5F depict lateral cross-sections through the supporting body portion of hollow shaft devices of FIG. 5D according to embodiments of the invention exploiting fluidic actuators.
Figure 5F:
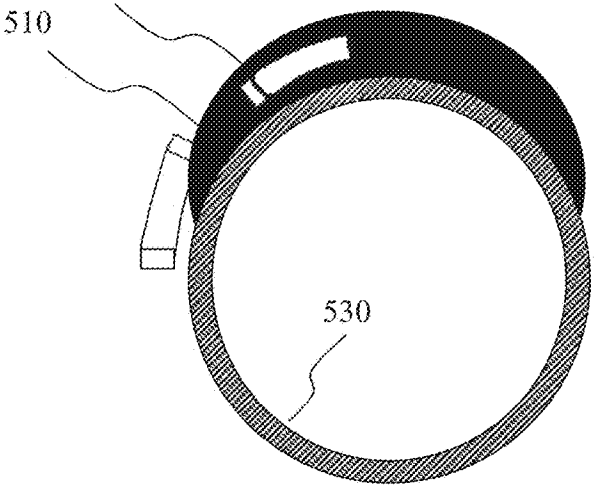
Figure 5D:
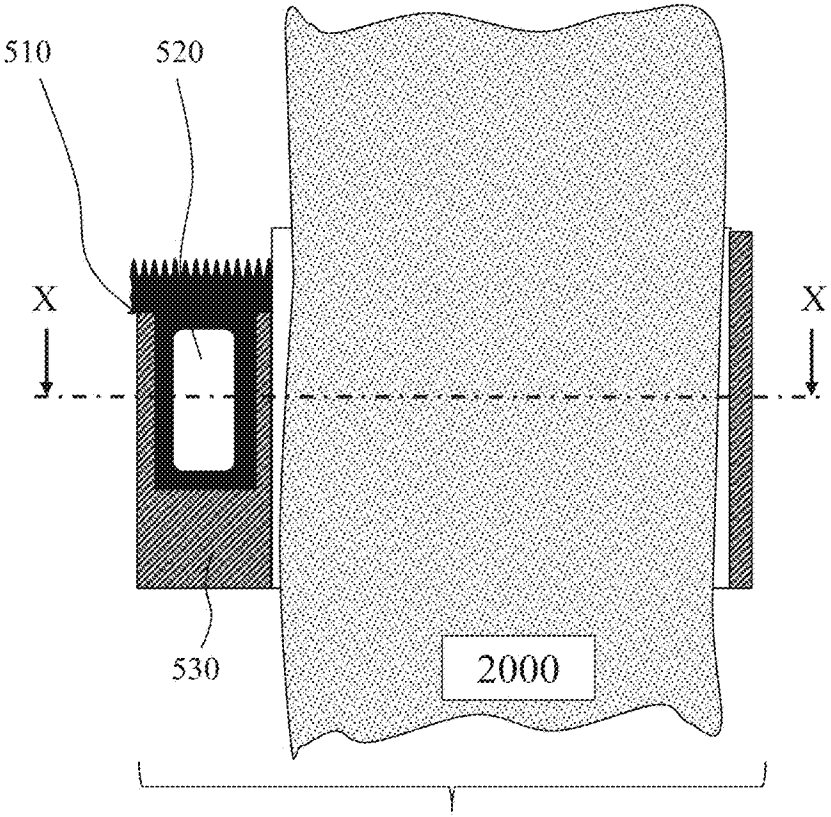
FIG. 5D depicts a longitudinal cross-section along the supporting body portion of a hollow shaft device according to embodiments of the invention exploiting fluidic actuators.

Referring to FIG. 5D there is depicted a longitudinal cross-section along the supporting body portion of a hollow shaft device according to embodiments of the invention exploiting fluidic actuators which is then depicted in FIGS. 5E and 5F in lateral cross-sections for expanded and compressed states of the fluidic actuator. Accordingly, a ring of resilient material 530 has an elastic portion, body of elastic material 510, with fluidic chamber 520. Accordingly, the expansion/contraction of the fluidic chamber 520 results in the outer surface of the elastic material moving against the user's or another user's skin resulting in a rubbing sensation. For example, if member 2000 is a penis, dildo or vibrator the ring device depicted may "rub" a clitoris of another user or the user. Alternatively, member 2000 may be a user's finger or toe.

Figure 6A:
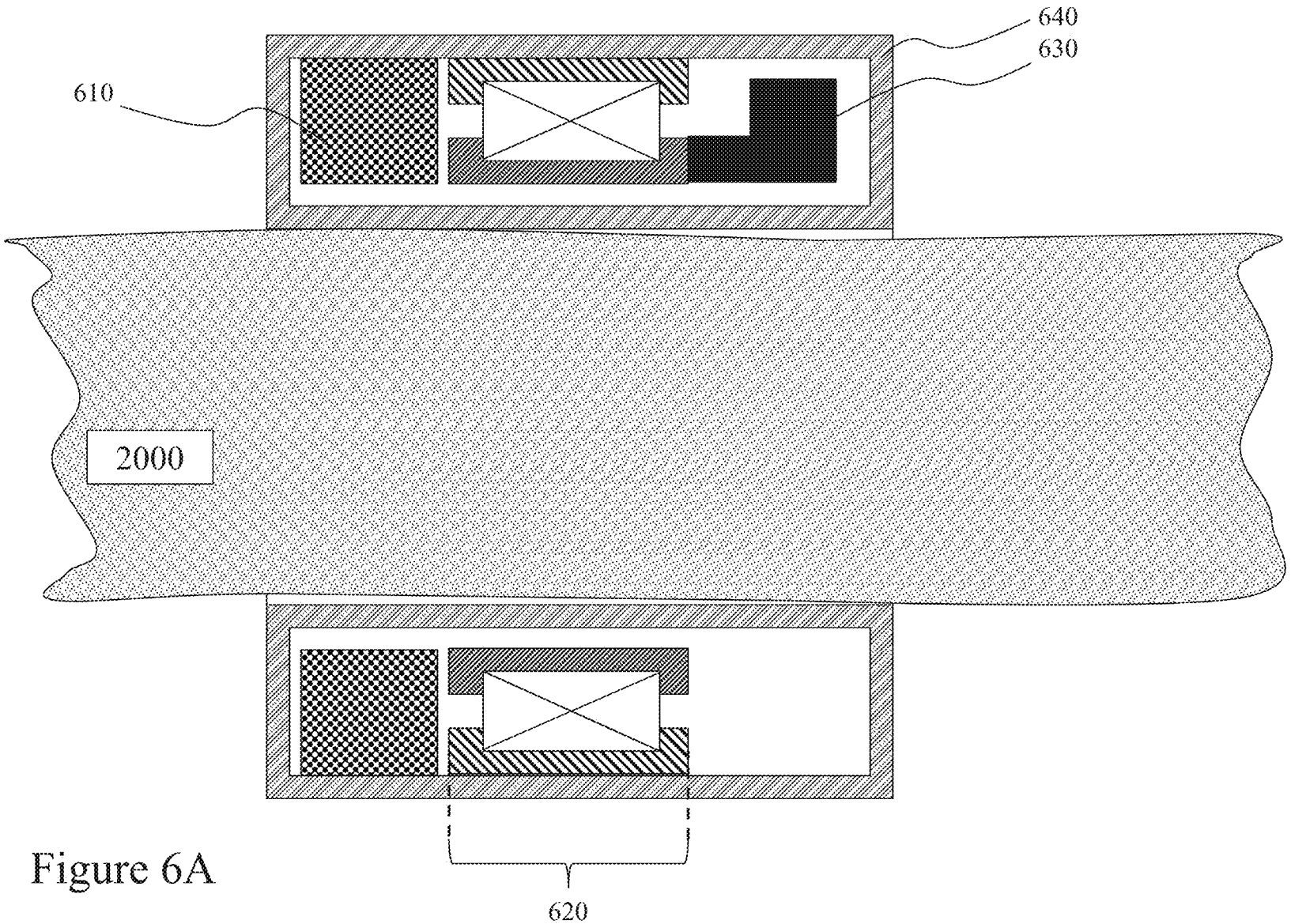
FIG. 6A depicts a longitudinal cross-section along the supporting body portion of a hollow shaft device according to embodiments of the invention exploiting hollow shaft motors.

Referring to FIG. 6A there is depicted a longitudinal cross-section along the supporting body portion of a hollow shaft device according to embodiments of the invention exploiting a hollow shaft motor 620 within a casing 640 such as one of the hollow shaft motors depicted in FIG. 1B. The hollow shaft motor 620 is controlled via controller 610 and has disposed upon it a weight 630 such that rotation of the hollow shaft motor 620 results in vibratory stimuli being applied to the member 2000 and any other body region either in contact with the device directly or the member 2000. Whilst the weight 630 is depicted disposed on one side of the hollow shaft motor 620 it would be evident that within other embodiments of the invention each side of the hollow shaft motor 620 may have a weight 630 attached at the same angular position relative to one another or offset by a predetermined angle according to the characteristics desired of the vibratory motion. Now referring to FIGS. 6B and 6C there are depicted longitudinal cross-sections along the supporting body portion of hollow shaft devices according to embodiments of the invention exploiting hollow shaft motors with contact to the supporting body portion. In each device depicted an inner element 650 is attached to the rotor of the rotary motor 620 and rotates with the motor against the member 2000. Within FIG. 6B the inner element 650 is within an opening within the inner annular body surface of the casing 640 whereas in FIG. 6C the inner element 660 extends beyond the inner annular body surface of the casing 640 along the member 2000. Optionally, the rotary motor 620 may be disposed along the inner element 650 rather than at one end.

Figure 6D:
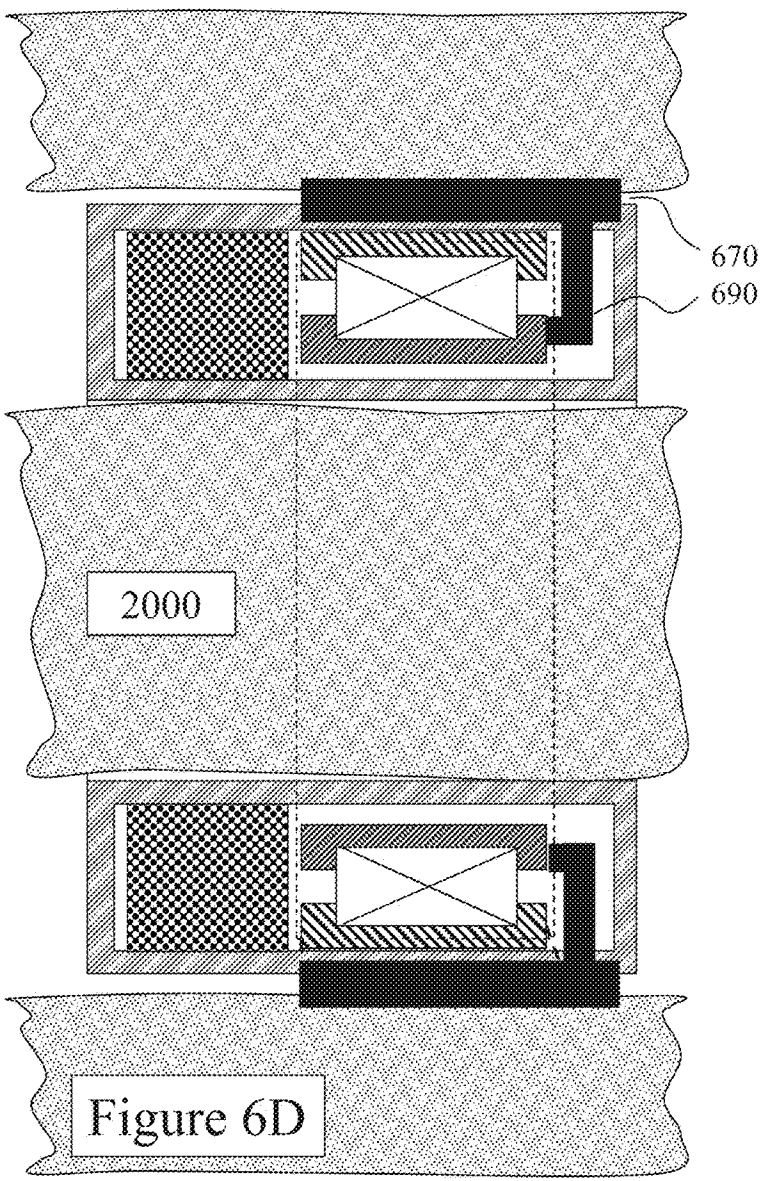
FIGS. 6D and 6E depict longitudinal cross-sections along the supporting body portion of hollow shaft devices according to embodiments of the invention exploiting hollow shaft motors with contact to another body portion within which the hollow shaft device has been inserted.
Figure 6B:
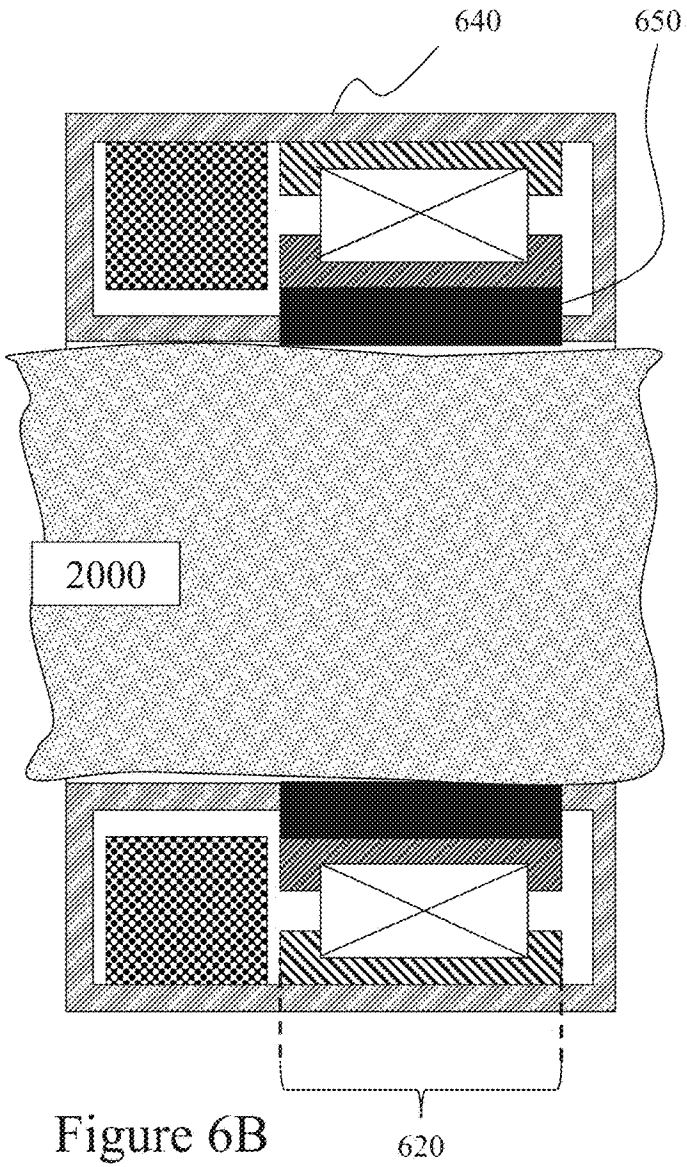
FIGS. 6B and 6C depict longitudinal cross-sections along the supporting body portion of hollow shaft devices according to embodiments of the invention exploiting hollow shaft motors with contact to the supporting body portion.
Figure 6C:
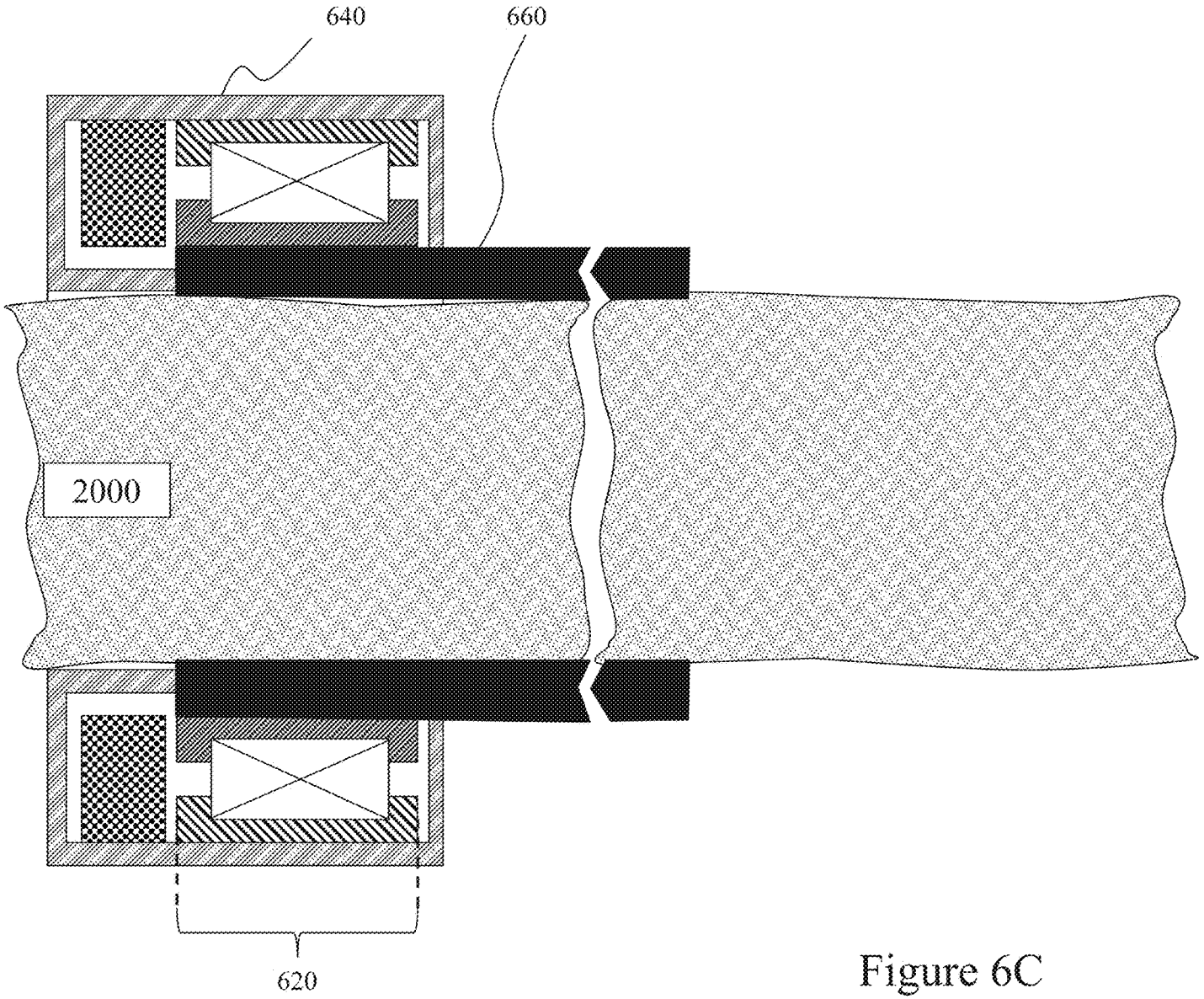
Figure 6E:
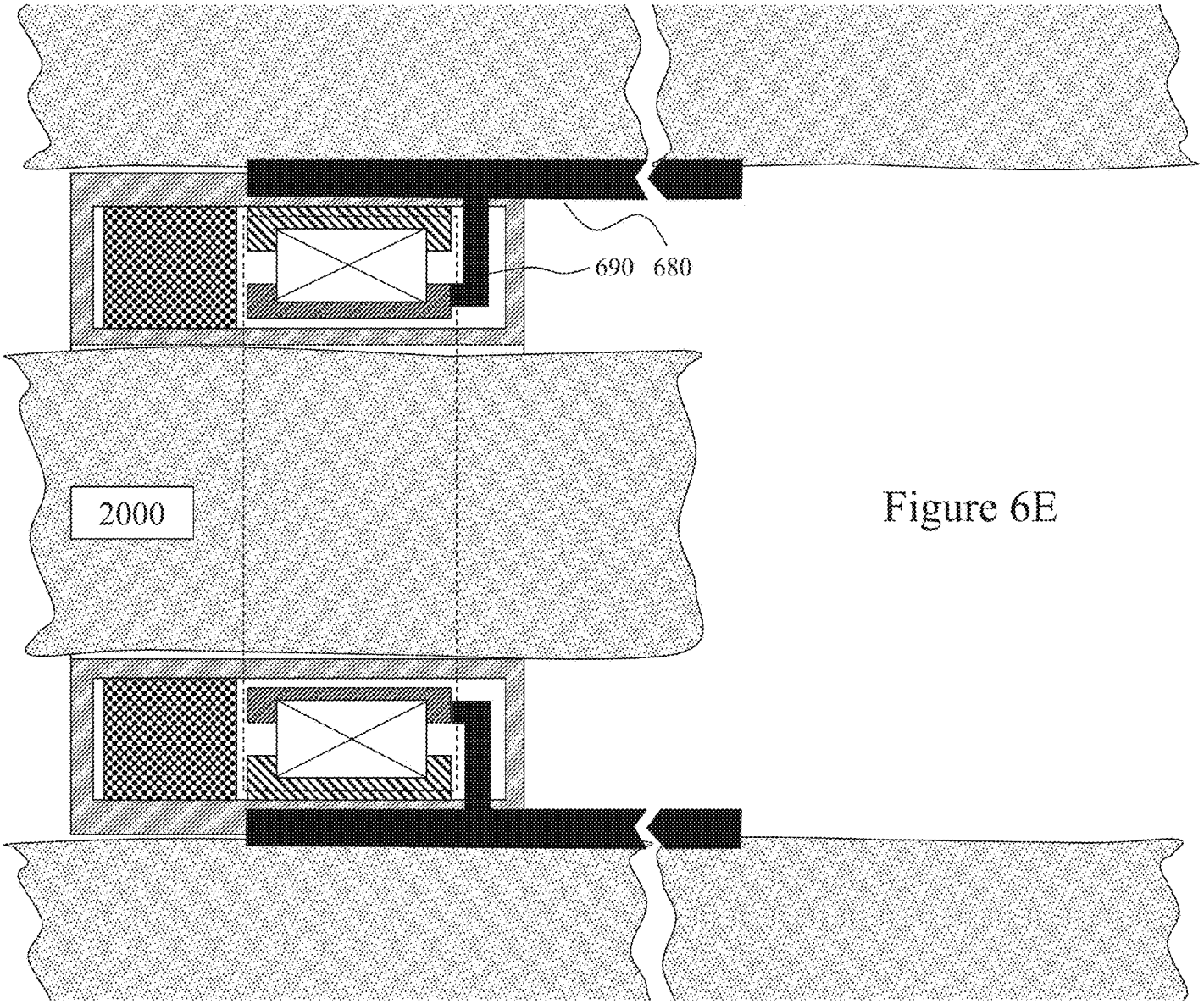

Now referring to FIGS. 6D and 6E there are depicted longitudinal cross-sections along the supporting body portion of hollow shaft devices according to embodiments of the invention exploiting hollow shaft motors with contact to the supporting body portion. In each device depicted an outer element is attached to the rotary motor 620 and rotates with the motor against the member 2000. Within FIG. 6D the outer element 670 is within an opening within the outer annular body surface of the casing 640 whereas in FIG. 6E the outer element 680 extends beyond the inner annular body surface of the casing 640 along the member 2000. In each instance the outer elements 670 and 680 are coupled to the rotor of the motor via arms 690. Optionally, the rotary motor 620 may be disposed along the outer element rather than at one end. It would be evident that within embodiments of the invention that inner and outer elements may be coupled to a common hollow shaft electrical rotary motor whereas within another embodiment a pair of hollow shaft electrical rotary motors may be employed with one for an inner element and the other for an outer element allowing these to operate independently to one another in rotation rate, rotation range, etc.

Whilst within FIGS. 6A to 6E a single hollow shaft motor stage is depicted around the member 2000 it would be evident that a device may employ one, two, three or more stages of hollow shaft motor stage may be employed under the action of a single controller. Optionally, a multi-stage hollow shaft motor driven device may be fully or partly modular such that, for example, a dual stage assembly can be extended with a single stage or with another dual stage wherein the mechanical attachment may provide for electrical connections allowing the stages to be controlled from a single controller. With encoders within each stage the electrical drive controller may establish a predetermined relationship between them when these each employ weights in order to establish the desired vibratory characteristics rather than having weights angularly offset to null the effect.

Figure 7A:
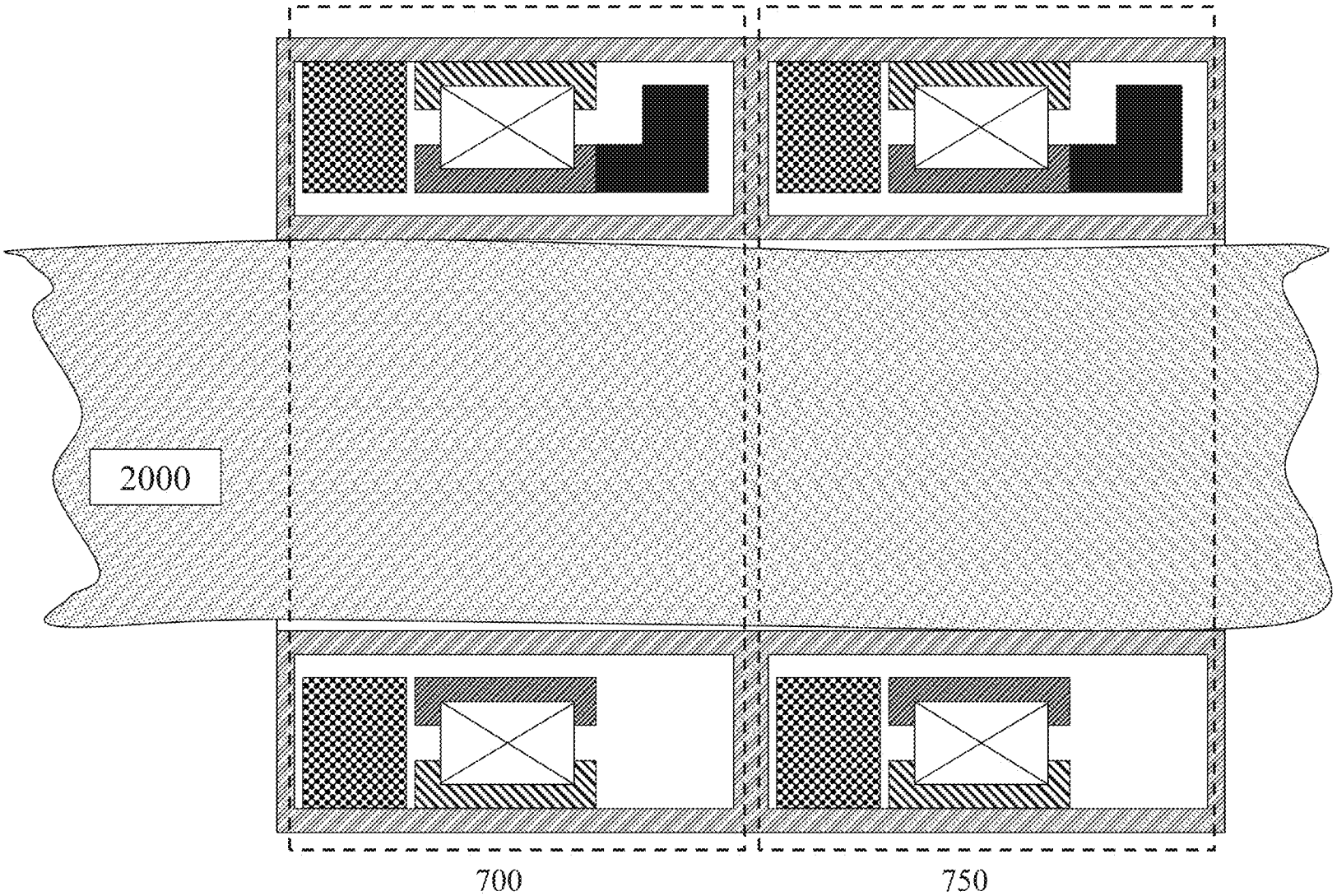
FIGS. 7A and 7B depict longitudinal cross-sections along the supporting body portions of hollow shaft devices according to embodiments of the invention exploiting hollow shaft motors.
Figure 7B:
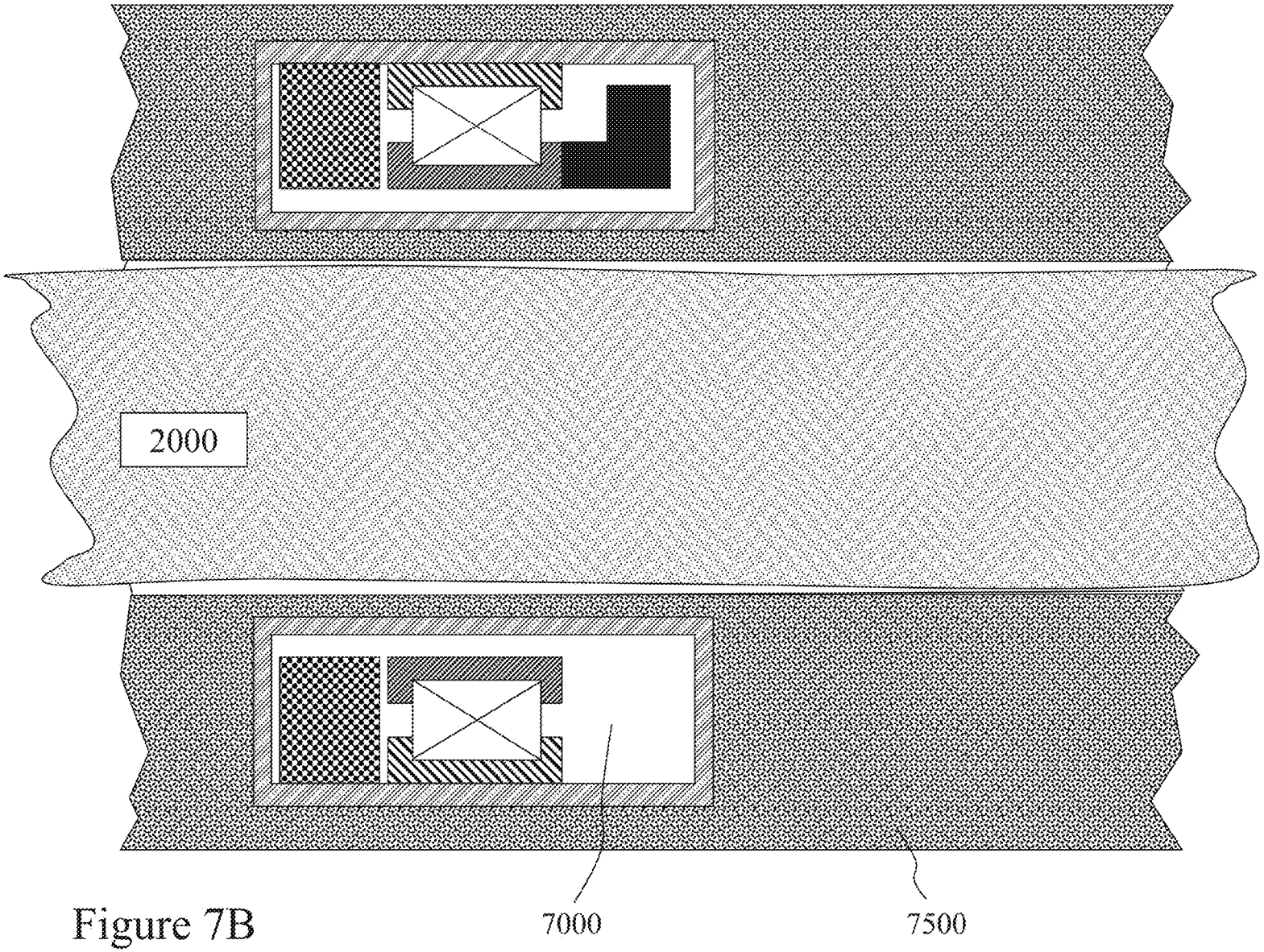

Such a dual stage hollow shaft electrical rotary motor configuration is depicted in FIG. 7A via a longitudinal cross-section along the supporting body portion of a hollow shaft device according to embodiments of the invention exploiting hollow shaft motors. In this instance each motor supports an asymmetric weight such as depicted in FIG. 6A. First and second motors 700 and 750 may be operated in multiple configurations with them rotating at same speed but slightly advanced positionally or aligned, different rotation rates, different rotation directions, etc. Alternatively, only one motor may be activated for some configurations and operating modes whereas in another both may or they may alternate. Referring to FIG. 7B a hollow shaft motor 7000 is depicted embedded within a body of a device 7500 rather than the hollow shaft motor being essentially the device itself.

Figure 7C:
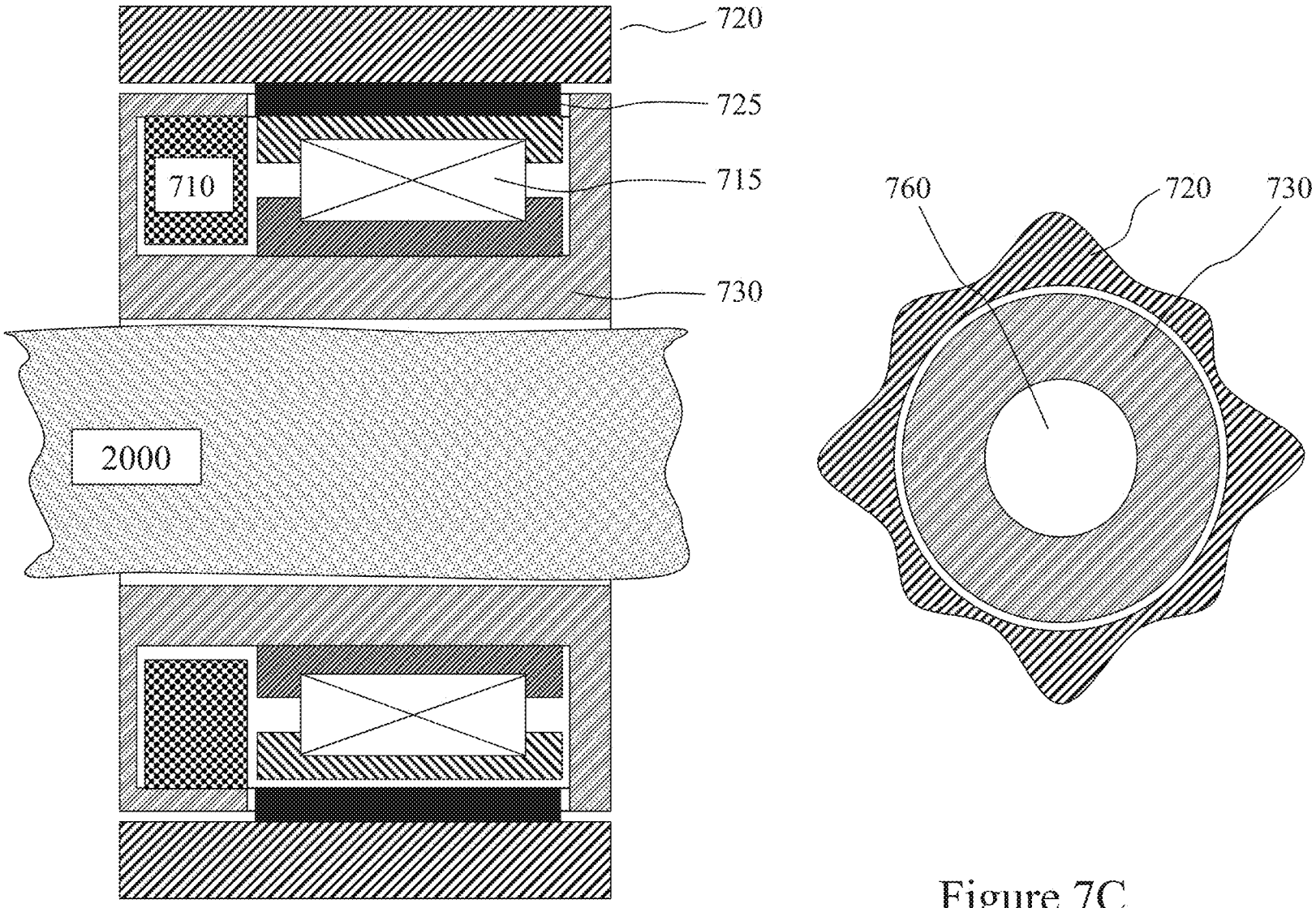
FIGS. 7C and 7D depict longitudinal cross-sections along the supporting body portions of hollow shaft devices according to embodiments of the invention exploiting hollow shaft motors as well as end elevations.
Figure 7D:
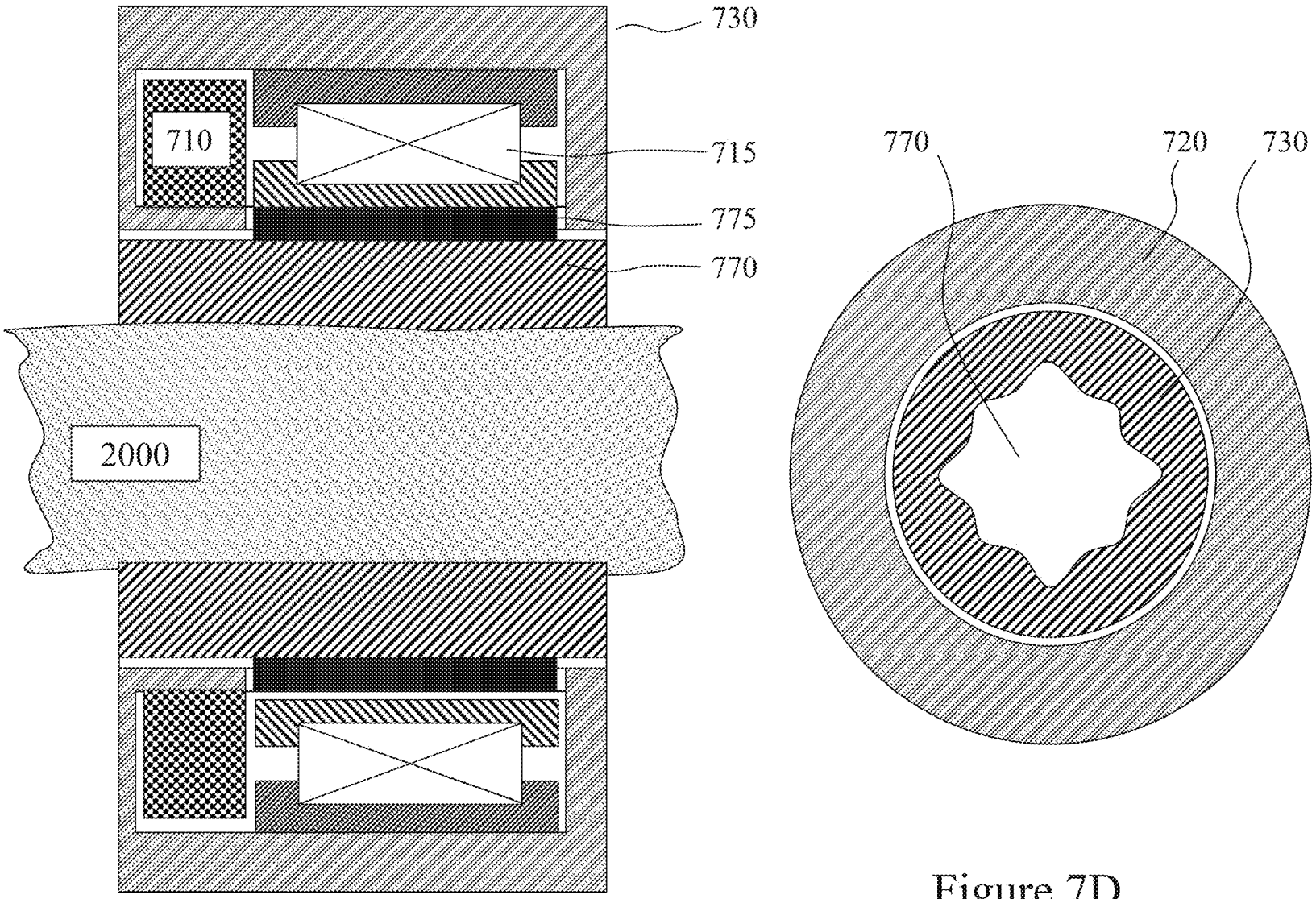

Now referring to FIGS. 7C and 7D there are depicted longitudinal cross-sections along the supporting body portions of hollow shaft devices according to embodiments of the invention exploiting hollow shaft motors as well as end elevations. Considering initially FIG. 7C then there is depicted a device comprising a hollow shaft motor 715 disposed within a shell 730 to a hollow shaft motor device according to an embodiment of the invention. As depicted the stator (stationary portion) of the hollow shaft motor 715 is attached to the shell 730 such that the stator rotates around the device and any member 2000 inserted within the hollow central region 760 of the device. Accordingly, a connection member 725 couples the stator portion of the hollow shaft motor to an outer ring 720 which will then rotate when the shell 730 is restrained against a portion of the user's body or held. For example, member 2000 may be a finger. Under action of the hollow shaft motor 715 the outer ring 720 therefore rotates and may, as depicted due to its profiled exterior surface, provide varying pressure to a body portion in contact with the exterior surface of the outer ring 720. Optionally, the outer ring 720 may be simply textured to provide frictional rubbing/heat generation and/or it may be profiled to provide time varying pressure such as for massaging. Optionally, the design of the hollow central region 760 may include a silicone ring to "fit" a range of member 2000 geometries. Optionally, the design of the hollow central region 760 may be other than circular such as, for example, elliptical allowing the device to be mounted over a pair of fingers, for example.

Now referring to FIG. 7D there is depicted a device comprising a hollow shaft motor 715 disposed within a shell 730 to a hollow shaft motor device according to an embodiment of the invention. As depicted the stator (stationary portion) of the hollow shaft motor 715 is attached to the shell 730 such that the stator rotates around the inner portion device and engages any member 2000 inserted within the hollow central region 760 of the device. Accordingly, a connection member 775 couples the stator portion of the hollow shaft motor to an inner ring 770 which will then rotate when the shell 730 is restrained against a portion of the user's body or held or forms part of a fixed and/or portable system providing sufficient mass/restraint/attachment such that the inner ring 770 rotates. For example, member 2000 may be a finger. Under action of the hollow shaft motor 715 the inner ring 770 therefore rotates and may, as depicted due to its profiled interior surface, provide varying pressure to a body portion in contact with the interior surface of the inner ring 770. Optionally, the inner ring 770 may be simply textured to provide frictional rubbing/heat generation and/or it may be profiled to provide time varying pressure such as for massaging. Optionally, the design of the device may include straps or other retaining features such that the shell 730 may be prevented to move such that the desired action of the stator of the hollow shaft motor is to rotate the inner ring 770 against the user's body.

Figure 7E:
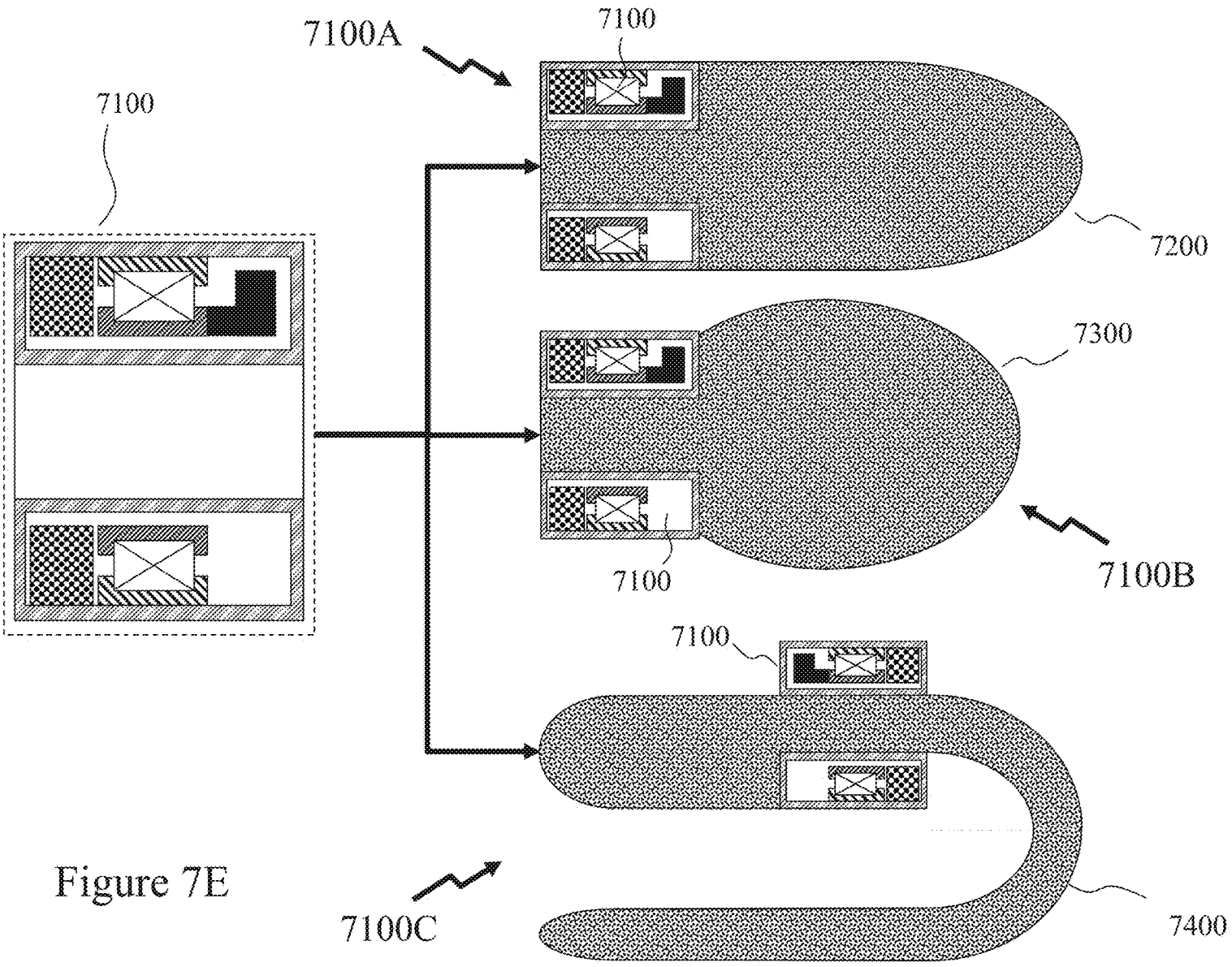
FIG. 7E depicts a hollow shaft vibratory device according to an embodiment of the invention being configured by detachable plugs.

Now referring to FIG. 7E there are depicted hollow shaft devices according to embodiments of the invention wherein a hollow shaft motor 7100 is configured into first to third devices 7100A to 7100C by exploiting different attachments which have a projection that fits into the centre empty region of the hollow shaft motor 7100. As depicted in first assembly 7100A the hollow shaft motor 7100 is attached to a first attachment 7200 such that the combination has a configuration similar to a compact adult toy known as a bullet vibrator allowing the first attachment to be inserted into an opening of the body such as vagina or anus. In second assembly 7100B the hollow shaft motor 7100 is attached to a second attachment 7300 which acts as a handle allowing the user to hold the second assembly 7100B in contact with a region of the user's body such as nipple or clitoris for example. In third assembly 7100C a the hollow shaft motor is attached to a C-shaped element 7400 allowing the hollow shaft motor 7100 to be configured as a low profile vibrator with an external portion adjacent the hollow shaft motor 7100 providing clitoral stimulation and a C-shaped portion that may be vaginally inserted for G-spot stimulation during intercourse in a design similar to that of U.S. Pat. No. 7,931,605 entitled "Electro-Mechanical Sexual Stimulation Device to be Worn during Intercourse." However, now rather than being a dedicated device the hollow shaft motor 7100 may be reconfigured between a first wearable, e.g. upon a user's finger for massage, and a second wearable to be worn during sexual intercourse.

First and second attachments 7200 and 7300 together with C-shaped element 7400 may be formed from different combinations of materials and structures including a scaffold and/or shell and/or casing according to the desired properties. For example, the inserted portion into the hollow shaft motor 7100 may be silicone or silicone ring around a harder core allowing the silicone to conform to the inner surface of the hollow shaft motor 7100 which may be circular, elliptical, or profiled such as described and depicted supra in respect of embodiments of the invention. Within other embodiments two or more hollow shaft motors 7100 may be attached to the same assembly element either at the same end or different ends. Where two or more devices are attached at the same end their controllers may be set to different frequencies such that the difference between them is a low frequency where in operation the user senses the difference frequency.

Figure 8:
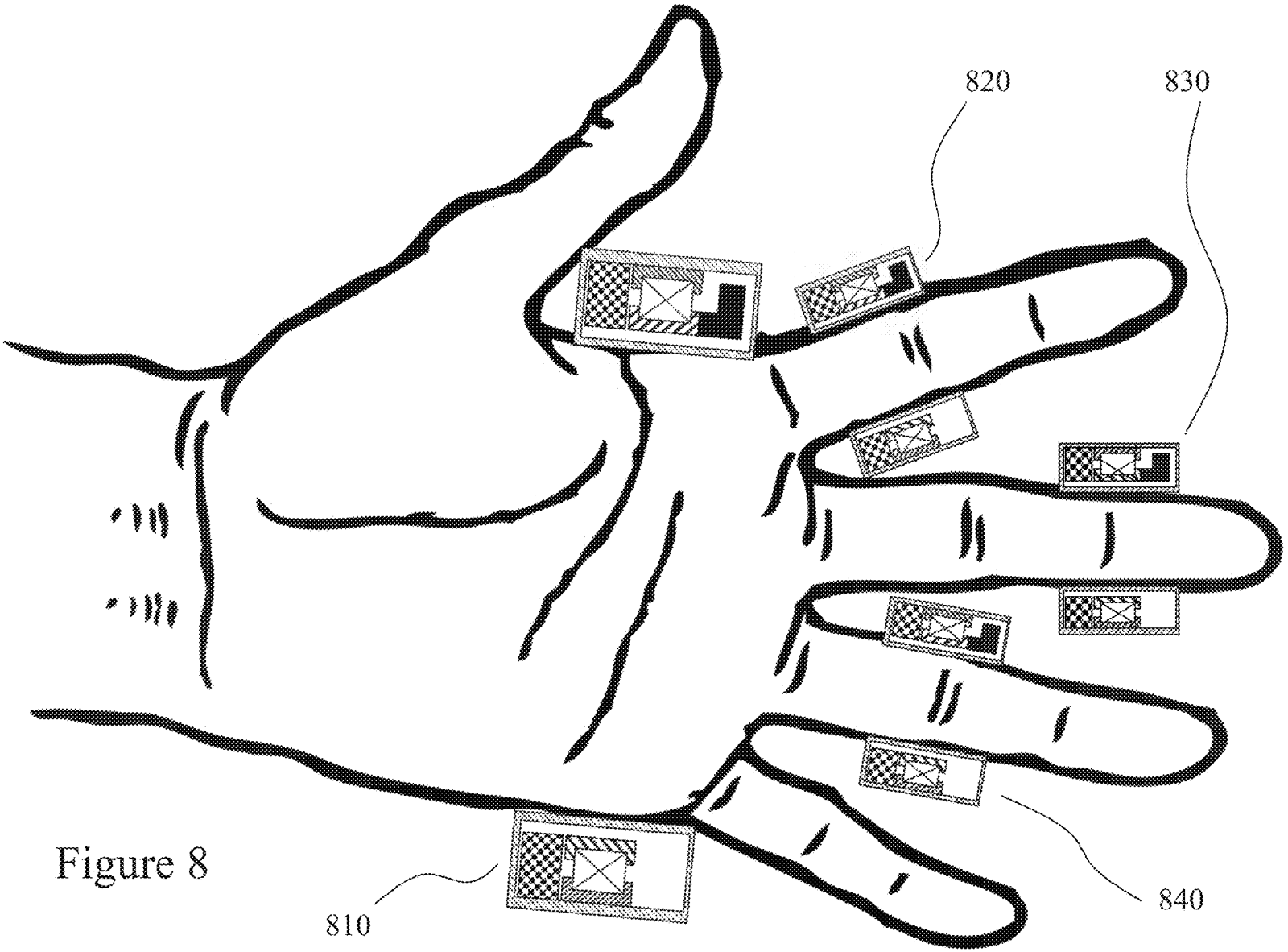

Referring to FIG. 8 there is depicted a combinational set of hollow shaft devices according to embodiments of the invention exploiting hollow shaft motors wherein a first motor 810 is around the palm and back of the user's hand and mounted upon their fingers are first to third hollow shaft motors. Dimensionally hollow shaft motors according to embodiments of the invention may be sized for fingers, thumbs, toes, palms, wrists, forearms, ankles, lower legs, thighs, and penis.

Figure 9:
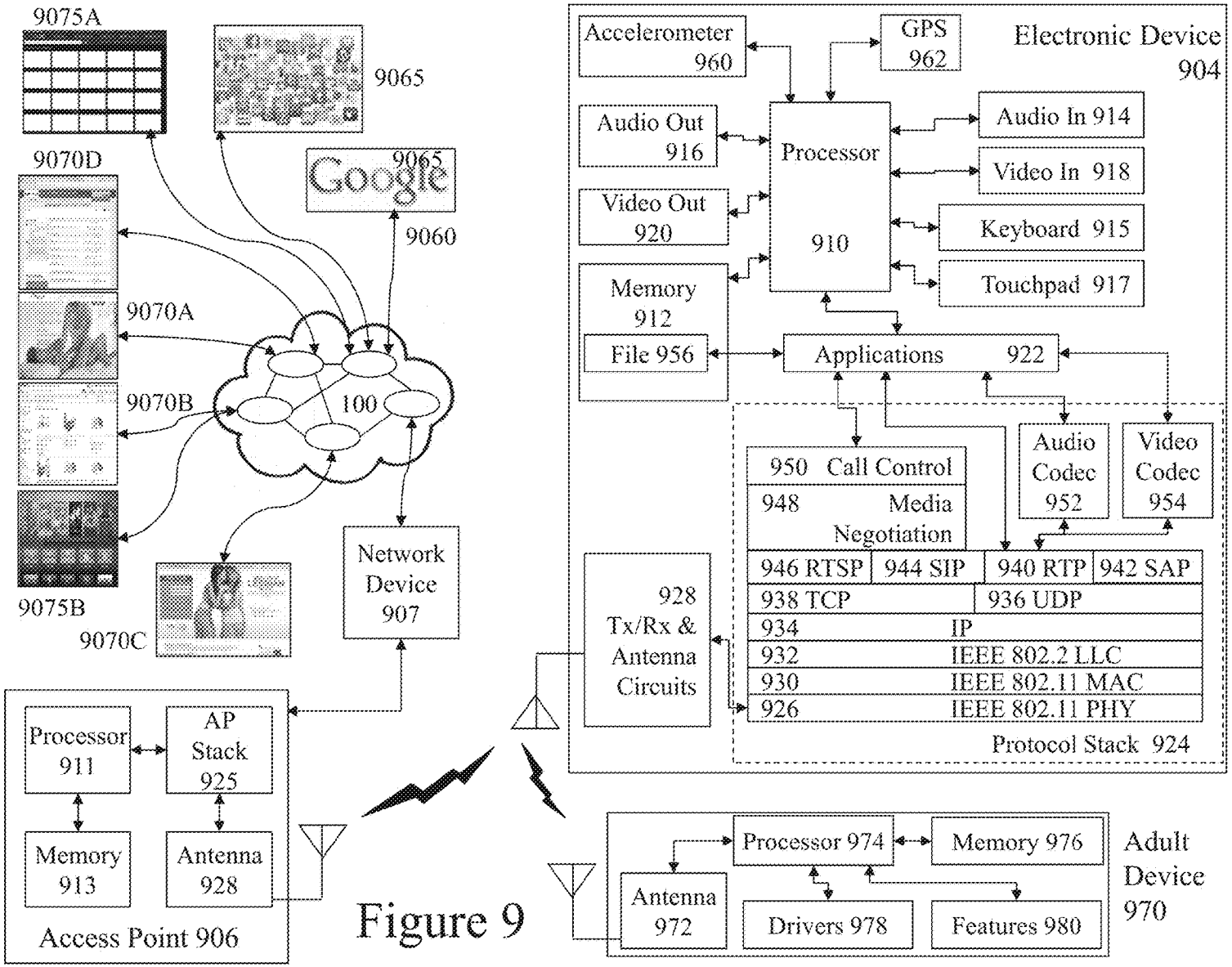

Now referring to FIG. 9 there is depicted an electronic device 204 and network access point 207 supporting ADSAP features according to embodiments of the invention. Electronic device 204 may, for example, be a PED and/or FED and may include additional elements above and beyond those described and depicted. Also depicted within the electronic device 204 is the protocol architecture as part of a simplified functional diagram of a system 200 that includes an electronic device 204, such as a smartphone 155, an access point (AP) 206, such as first AP 110, and one or more network devices 207, such as communication servers, streaming media servers, and routers for example such as first and second servers 190A and 190B respectively. Network devices 207 may be coupled to AP 206 via any combination of networks, wired, wireless and/or optical communication links such as discussed above in respect of FIG. 1 as well as directly as indicated. Network devices 207 are coupled to network 100 and therein Social Networks (SOCNETS) 9065, search engine 9060, device manufacturer 9070A, e.g. We-Vibe™ by Standard Innovation Corporation; online retailer 9070B, e.g. Amazon™; online personals website 9070C, e.g. PinkCupid™; online chat/discussion/bulletin board/forum 9070D, e.g. www.sexforums.com; adult multimedia content website 9075A, e.g. RedTube™; and multimedia content website 9075B, e.g. iTunes™.

The electronic device 904 includes one or more processors 910 and a memory 912 coupled to processor(s) 910. AP 906 also includes one or more processors 911 and a memory 913 coupled to processor(s) 910. A non-exhaustive list of examples for any of processors 910 and 911 includes a central processing unit (CPU), a digital signal processor (DSP), a reduced instruction set computer (RISC), a complex instruction set computer (CISC) and the like. Furthermore, any of processors 910 and 911 may be part of application specific integrated circuits (ASICs) or may be a part of application specific standard products (ASSPs). A non-exhaustive list of examples for memories 912 and 913 includes any combination of the following semiconductor devices such as registers, latches, ROM, EEPROM, flash memory devices, non-volatile random access memory devices (NVRAM), SDRAM, DRAM, double data rate (DDR) memory devices, SRAM, universal serial bus (USB) removable memory, and the like.

Electronic device 904 may include an audio input element 914, for example a microphone, and an audio output element 916, for example, a speaker, coupled to any of processors 910. Electronic device 904 may include a video input element 918, for example, a video camera or camera, and a video output element 920, for example an LCD display, coupled to any of processors 910. Electronic device 904 also includes a keyboard 915 and touchpad 917 which may for example be a physical keyboard and touchpad allowing the user to enter content or select functions within one of more applications 922. Alternatively, the keyboard 915 and touchpad 917 may be predetermined regions of a touch sensitive element forming part of the display within the electronic device 904. The one or more applications 922 that are typically stored in memory 912 and are executable by any combination of processors 910. Electronic device 904 also includes accelerometer 960 providing three-dimensional motion input to the process 910 and GPS 962 which provides geographical location information to processor 910.

Electronic device 904 includes a protocol stack 924 and AP 906 includes a communication stack 925. Within system 900 protocol stack 924 is shown as IEEE 802.11 protocol stack but alternatively may exploit other protocol stacks such as an Internet Engineering Task Force (IETF) multimedia protocol stack for example. Likewise, AP stack 925 exploits a protocol stack but is not expanded for clarity. Elements of protocol stack 924 and AP stack 925 may be implemented in any combination of software, firmware and/or hardware. Protocol stack 924 includes an IEEE 802.11-compatible PHY module 926 that is coupled to one or more Tx/Rx & Antenna Circuits 928, an IEEE 802.11-compatible MAC module 930 coupled to an IEEE 802.2-compatible LLC module 932. Protocol stack 924 includes a network layer IP module 934, a transport layer User Datagram Protocol (UDP) module 936 and a transport layer Transmission Control Protocol (TCP) module 938. Protocol stack 924 also includes a session layer Real Time Transport Protocol (RTP) module 940, a Session Announcement Protocol (SAP) module 942, a Session Initiation Protocol (SIP) module 944 and a Real Time Streaming Protocol (RTSP) module 946. Protocol stack 924 includes a presentation layer media negotiation module 948, a call control module 950, one or more audio codecs 952 and one or more video codecs 954. Applications 922 may be able to create maintain and/or terminate communication sessions with any of devices 907 by way of AP 906.

Typically, applications 922 may activate any of the SAP, SIP, RTSP, media negotiation and call control modules for that purpose. Typically, information may propagate from the SAP, SIP, RTSP, media negotiation and call control modules to PHY module 926 through TCP module 938, IP module 934, LLC module 932 and MAC module 930. It would be apparent to one skilled in the art that elements of the electronic device 904 may also be implemented within the AP 906 including but not limited to one or more elements of the protocol stack 924, including for example an IEEE 802.11-compatible PHY module, an IEEE 802.11-compatible MAC module, and an IEEE 802.2-compatible LLC module 932. The AP 906 may additionally include a network layer IP module, a transport layer User Datagram Protocol (UDP) module and a transport layer Transmission Control Protocol (TCP) module as well as a session layer Real Time Transport Protocol (RTP) module, a Session Announcement Protocol (SAP) module, a Session Initiation Protocol (SIP) module and a Real Time Streaming Protocol (RTSP) module, media negotiation module, and a call control module. Portable and fixed electronic devices represented by electronic device 904 may include one or more additional wireless or wired interfaces in addition to the depicted IEEE 802.11 interface which may be selected from the group comprising IEEE 802.15, IEEE 802.16, IEEE 802.20, UMTS, GSM 850, GSM 900, GSM 1800, GSM 1900, GPRS, ITU-R 5.138, ITU-R 5.150, ITU-R 5.280, IMT-1000, DSL, Dial-Up, DOCSIS, Ethernet, G.hn, ISDN, MoCA, PON, and Power line communication (PLC).

Also depicted is ADult DEVice (ADDEV) 970 which is coupled to the electronic device 904 through a wireless interface between Antenna 972 and Tx/Rx & Antenna Circuits 928 wherein the electronic device 904 may support, for example, a national wireless standard such as GSM together with one or more local and/or personal area wireless protocols such as IEEE 802.11 a/b/g WiFi, IEEE 802.16 WiMAX, and IEEE 802.15 Bluetooth for example. The Antenna 972 is connected to Processor 974 and therein to Memory 976, Drivers 978, and Features 980. Accordingly, the ADDEV 970 may operate as standalone device with factory installed control routines accessed through an interface on the ADDEV 970, not shown for clarity, or through an application in execution upon the electronic device 904. Subsequently, as described below one or more of these control routines may be modified, amended, deleted etc. whilst other new control routines may be created, acquired, installed etc.

Accordingly, it would be evident to one skilled the art that the ADDEV 970 with associated electronic device 904 may accordingly download original software and/or revisions for a variety of functions supported by the drivers 978 and/or features 980. In some embodiments of the invention the functions may not be implemented within the original as sold ADDEV 970 and are only activated through a software/firmware revision and/or upgrade either discretely or in combination with a subscription or subscription upgrade for example.

It would be evident to one of skill in the art that the hollow shaft devices described and depicted in respect of FIGS. 1A to 9 may be designed with different users of the same species in mind or of different species and/or different regions of the user's body. For example, a hollow shaft device designed to fit upon a finger of a male human would differ from one intended to massage their calf muscles or one designed for a dog, cat, horse etc.

Amongst the multiple device types that can be implemented and constructed using embodiments of the invention described and depicted supra in respect of FIGS. 1A to 9 is a muscle massager. For example, FIG. 7C depicts a configuration suitable for exploiting as a muscle massager although other designs and embodiments of the invention may also provide a massager and/or muscle massager rather than a device for sexual stimulation. Some devices may provide both therapeutic and sexual functions. As noted supra the design may be such that the central hollow portion of the device is large enough for fitting two fingers into and it may have a thin or thick silicone portion on the inside of the ring allowing for the silicone (or other material) to stop the action of the device numbing a user's fingers and also not let fingers soak up the vibration/pressure energy so it is left to impart on the body by contact with the outside of the ring.

Optionally, the inner portion of the hollow motor device may be formed from an appropriate formable thermo-plastic or accept an insert of an appropriate formable thermo-plastic such as poly (ethylene-vinyl acetate) (PEVA) or low density polyethylene for example allowing an inner portion designed to fit and be retained against inserted member 2000 (as opposed to inner portion rotate against the member 2000) allowing the inner portion of the hollow shaft device to be formed/customized in shape to the user. For example, a ring of thermoplastic with an outer ring of a non-thermoplastic material allows the hollow portion to be formed/customized in shape whilst the outer periphery is unmodified and engages the inner portion of the actual hollow shaft motor device. Optionally, variants of this approach may allow for inner and/or outer portions of the overall device to be removed allowing them to be cleaned without exposing the hollow shaft motor device body itself to water, disinfectant, and/or other cleaning agents. This also allows for disposable portions of the hollow shaft motor in other embodiments of the invention.

Accordingly, the inner thermoplastic ring can be custom shaped to fit a user's penis or finger whilst in other embodiments of the invention an outer/external surface can have custom shape for the desired shape to fit against a desired body part well. Within other embodiments of the invention the inner ring and/or outer ring may be formed from a low or very low durometer silicone to fit and adapt to different body portion dimensions. In such embodiments the low durometer silicone will isolate the body portion to which the hollow shafted motor device is attached from the action of the outer portion of the device, e.g. a device mounted to a user's finger may act as a muscle massager or sexual stimulator without significant pressure and/or vibration being coupled to the user's finger(s).

As noted supra the design of the hollow shaft rotary motors such as those depicted in respect of FIGS. 6A to 8 is not presented in detail as a variety of designs such as, but not limited to, those depicted in FIG. 1B may be employed. Common to these rotary motors and some linear motors that may be employed within embodiments of the invention are bearings. These may be based upon designs including, but not limited to, roller, pin, and ball for example or these may employ bushings using low friction plastic for example. Design considerations such as dry bearings versus greased bearings or low friction plastic versus sintered oil impregnated bronze etc. are tradeoffs according to the intended use, body parts engaged both within the hollow central portion and the exterior surface(s), the intended lifetime, cost, manufacturing complexity etc. Such bearings or bearing surfaces are not depicted within FIGS. 1A to 8 for clarity. Embodiments of the invention even with large hollow portion diameters are generally low powered motors relative to their diameter representing a design space not typically encountered within prior art hollow shaft motors where high speeds, high torque etc. are design drivers given these motors being employed typically within machinery and medium/large mechanical systems. Embodiments of the invention may employ low friction plastics, such as Teflon™ or PEEK/PTFE (polyetheretherketone/polytetrafluoroethylene) with/without silicon impregnation to achieve coefficient of friction below 0.1, below 0.08, and below 0.05 whilst come may offer down to 0.02 with super low friction plastics alone or in combination with one or more other materials applied such as by anodizing, plating, vapour deposition, thermal spray etc. according to the base material (s). Within embodiments of the invention designs may achieve the desired performance with or without boundary lubricants.

It would be evident to one of skill in the art that hollow shaft motor designs offer advantages with respect to their use. For example, putting the motor around the user's finger allows for the overall combination to have a lower profile compared to having the entire motor under your finger. Beneficially, the large radius for the eccentric weight implies a large swing yielding larger forces for a given weight so can provide larger amplitude variations of applied pressure. This is particularly beneficial in finger cot and/or glove type applications. Further, as the frequency is defined by the rotational frequency then these actuators can provide low frequency, high amplitude stimulation to a portion of the user's body. This effect is similar to a "rumble."

It would be evident that devices exploiting hollow shaft motors and/or hollow shaft actuators according to embodiments of the invention may be fixed in configuration apart from those elements exploiting hollow shaft motors and/or hollow shaft actuators or that the device configuration may be varied in a continuous or discrete manner. For example, configuring the geometry of an ADDEV in overall length may exploit a telescoping scaffold for example which locks through a simple rotatory motion, for example, or other mechanism as known in the art. Alternatively, an expandable skin may be used in conjunction with a screw-thread extension means for example. Optionally, a device may separate into two parts allowing insertion of extending elements wherein these may additionally comprise electrical and/or fluidic connections to link the original elements for functionality etc. Optionally, these additional elements may contain other active elements, e.g. another hollow shaft motor for example, wherein power/data connections to a controller/battery assembly are provided and automatic detection of the configuration performed by the controller, e.g. detecting a voltage at a pin through this now being connected.

Embodiments of the invention may exploit electrical hollow shaft motor(s) in conjunction with other active elements including, but not limited to, devices such as linear oscillators, linear translation, electromagnetic piston actuators, and fluidics.

It would be evident to one of skill in the art that in addition to vibratory and/or pressure based stimulation that embodiments of the invention may employ other therapeutic and/or stimulation means including but not limited:

Light therapy such as visible, ultra-violet and infrared for example;

Ultrasonic therapy with ultrasonic vibrations applied;

Electrostimulation wherein electrical contacts to the user's body provide electrical stimulation;

Pharmaceutical medications, wherein embodiments of the invention may apply continuously or periodically a medication, pharmaceutical composition, pharmaceutical compound or drug via surface absorption, injection, etc.

Whilst within the preceding Figures the body of the insertable portion has not been described or depicted in detail although these may be similar to one or more prior art dildos and/or vibrators and other ADDEVs. The outer surface of the insertable portion of the adult device may be smooth, contoured, grooved, ribbed, and/or comprise bumps and/or nubbies. Optionally, the contours may extend further across the upper surface of the ADDEV or they may be more centrally limited. Optionally, the depth, spacing, and number of grooves, ribs, bumps, or nubbies may vary as well as their surface profile from symmetric to asymmetric etc. Optionally, the upper surface may be smooth or it may be profiled by the distribution of nubbies across upper surface regions in some embodiments of the invention. Within others features that have multiple "fingers" or "fronds" may be employed to provide different sensations. Optionally different regions of the ADDEV may have different structures such as nubbies, grooves, smooth areas etc. on the upper central bump as well as its sides.

The ADDEV may be provided in a range of physical sizes such that, for example, the length of the member inserted portion may be 15 mm, 25 mm, 35 mm, 40 mm, 50 mm, 65 mm, 75 mm, 100 mm, 125 mm, 150 mm, or 200 mm for example (0.6", 1", 1.4", 1.6", 2", 2.5", 3", 4", 5", 6" or 8") and it's lateral dimensions may be, for example, 10 mm, 12.5 mm, 15 mm, 25 mm, 35 mm, 40 mm, 50 mm, or 75 mm (0.4", 0.5", 0.6", 1", 1.4", 1.6", 2", or 3"). Similarly, lengths between hollow motors and other hollow motors and/or fluidic/linear actuators etc. may be provided in different dimensions. Where an anal insertion element is provided its length and lateral dimensions may be over a similar range as the vaginally inserted portion. Whilst typically the member surrounding portion will have limited width variations along its length some ADDEVs may have larger width variations and may have a length/width ratio lower than other ADDEVs. However, other dimensions, aspect ratios, cross-section geometries etc. may be employed without departing from the scope of the invention.

Typically, the construction of an ADDEV such as depicted within embodiments of the invention described in respect of FIGS. 2A to 8 will employ one or more central scaffolds/resilient elements which provide rigidity to the required portions of the ADDEV which may be surrounded by a shell and then a casing. Whilst the casing and shell may be transparent or semi-transparent over portions or all of the ADDEV it is common for the ADDEV to be opaque. An outer casing may be coloured based upon skin colour tones based upon ethnicity or personal preference, e.g. Caucasian, Negroid, Mongol, light, dark, etc. as well as single colour, binary colour, multiple colour etc. According to the complexity acceptable then the outer casing may be formed from a variety of colours and/or be patterned for a specific design. Typically, such colours will be part of a silicone or other elastomer employed in forming the casing although in other embodiments of the invention the casing may be coloured once formed and a protective fluid proof, non-toxic, non-abrasive coating formed atop these applied colours. Such instances of applied colours may include metallic lacquers, particulate lacquers for "sparkle", etc. Exploitation of silicone coatings for the flexible drive shaft allows similar options although pigmenting of a wide variety of plastics employed in cables etc. may also be employed for outer casings of flexible drive shafts formed from other plastics and/or elastomers.

Optionally, the silicone may be clear and either embedded into the silicone or a shell of the ADDEV are LEDs, such as multi-colour LEDs for example, allowing the colour of the ADDEV to be varied either statically or dynamically, such as for example in response to commands from an associated PED generated in response to controlling ambient light, music, audiovisual content etc. Beneficially, medical grade silicone is clear thereby removing the requirement for any additional coating (e.g. food grade urethane) in conjunction with pigmented silicones. Accordingly, an ADDEV may with medical grade silicone be clear and formed from an initial sticky soft silicone, e.g. 20 durometer, with a micro-layer (spray coated for example) of high durometer medical grade silicone, for example 70-90 durometer, to create "slippery" surface and avoid silky smooth surface that typically requires use of urethane coating.

Typically, the casing for the ADDEV will be formed from a non-toxic, hypoallergenic silicone to provide a safe smooth surface although some regions of the ADDEV may be coated, textured and/or finished with a variation from that of the remainder of the casing in order to enhance or promote retention of the ADDEV against the user's skin or clothing. Typically, the outer surface of the casing will be formed to provide low friction as well as resistance to lubricants that may or may not be employed.

Typically, within the outer silicone or elastomeric casing is a shell that houses internally, in the embodiments presented, vibratory motors, battery, control circuit and charging port. Within embodiments of the invention other functional elements may be employed for generating physical stimulus, providing user interface, wireless transceiver for communicating to an associated electronic device (PED or FED) or other ADDEV, etc. Within the description of embodiments of the invention and associated figures such elements are not presented for clarity of description, figures etc. However, such elements may or may not be implemented within embodiments of the invention. Accordingly, the shell may comprise a single chamber or a plurality of chambers and may be formed from one-piece part or multiple piece parts which are connected via the casing and/or discrete or connected by a central portion with different degrees of rigidity range from solid to a living hinge.

Optionally, the ADDEV may employ one, two, three or more hollow shaft motors as well as actuators of one, two or more different technical approaches. For example, one or more hollow shaft motors may provide high end vibrations whilst one or more vibratory or high impact gear-reduced motors may provide a low frequency "rumble" from larger weighted motors or through controlled frequency offset "throbbing" or vice-versa. Optionally, linear vibratory motors may be disposed within the regions on the outer surface of the recipient's body or the inserted portion(s) whilst generally rotating asymmetric weight motors are within the shell of the inserted portion(s). Optionally, the outer surface of the ADDEV may provide electrical stimulation contacts through metal contacts or conductive silicone pads for example at predetermined locations on either the member inserted portion or the external surfaces.

Embodiments of the invention with respect to controlling an ADDEV such as described within the embodiments of the invention supra in respect of FIGS. 2A to 8 may employ one or more methodologies as known within the art. Such control may be provided, for example, through a remote control wirelessly connected to the ADDEV, a PED or FED wirelessly connected to the ADDEV, a remote control wired to the ADDEV, and a control interface on the ADDEV allowing selection of predetermined program. In instances of wireless interfaced controllers, the control may be local, i.e. by a user engaged in a sexual activity involving the ADDEV, or the control may be remote.

Embodiments of the invention with respect to powering an ADDEV such as described within the embodiments of the invention supra in respect of FIGS. 2A to 8 may employ one or more methodologies as known within the art. For example, the ADDEV may comprise a rechargeable battery or batteries within the shell which may be of a standard form/type, such as AA, AAA, etc. or custom to the ADDEV and/or another product. Alternatively, the ADDEV may employ non-rechargeable batteries and require an access to allow in insertion/removal of the battery or batteries or the ADDEV may be disposed of once the batteries have been exhausted. Optionally, the ADDEV may be powered directly from electrical mains supply through a transformer to support extended use or high power requirements not supportable by realistic battery configurations allowing extended use. Where an electrical connection is made to the ADDEV this may be similarly via a technique known in the prior art such as plug-socket connection, magnetic electrical connectors, etc.

Embodiments of the invention with respect to the ADDEV may employ a "sticky" surface for the outer surface engaging a recipient's body (e.g. being formed from a low durometer silicone for example) so that the surface is designed to "stick" to skin so it stays in place. This "sticky" surface may be mirror surface, matt or textured for grip. Examples of materials may be those with durometer ideal Shore A10 or lower, Shore A5 or lower, or Shore A1. In some embodiments of the invention a region or regions of the casing may be formed from a gel such as the Ecoflex™ platinum catalyzed silicones for example certified to ISI 10993-10 for skin irritation/sensitization and having, for example, Shore 00-50 hardness (below the Shore A scale), Shore 00-30 hardness, Shore 00-20 hardness, or Shore 00-10 hardness. Within embodiments of the invention the footprint of the casing may be significantly larger than the shell (mechanical assembly) footprint, larger than the shell print, approximately the same as the shell footprint, and smaller than the shell footprint. Where the shell footprint is larger than the shell footprint its mechanical structure may be such that it does not droop under its weight/gravity when held free, droops a small amount, droops a moderate amount, or droops completely according to the desired characteristics. In embodiments of the invention the casing around the shell may act like a thin sheet (<<1 mm thick), like a fabric or material, like a sheet (~1 mm), a thick sheet (>1 mm). Optionally, the lower surface of the casing designed for placement against a user's groin/stomach may be sticky and when washed recover this stickiness in its entirety or in different regions or areas.

Optionally, the outer surface which may contact the user may be smooth with low friction to human skin, smooth with minimal friction to human skin, smooth with moderate friction to human skin, smooth with high friction to human skin in its entirety or in different regions or areas. Alternatively, the surface may be smooth, textured, and/or rough and have low friction, negligible friction, moderate friction, and/or high friction in its entirety or in different regions or areas. Optionally, the surface may be textured with low friction to human skin, textured with minimal friction to human skin, textured with moderate friction to human skin, or textured with high friction to human skin in its entirety or in different regions. Optionally, the surface of the casing in its entirety or in different regions or areas may be used in conjunction with disposable sheets that provide adhesion and/or friction in predetermined levels.

Within embodiments of the invention the casing, for example formed from silicone, is the only material surrounding the casing and the surface profile is derived from applying the casing to the contoured surface of the shell. In other embodiments of the invention the surface profile is derived from multiple applications of a single material forming the casing. In other embodiments of the invention an additional material or materials are disposed between the shell and the casing. This, may for example, be a preform formed from the same material as the casing such that the casing is applied as a single or multiple dip coating for example, a preform formed from another silicone of different characteristics to the casing, a preform formed from a plastic, a preform formed from a low density foam, from a medium density foam, or a high density foam. Alternatively, a combination of materials may be employed such as two or more plastics, two or more foams, a foam and a plastic, a foam and a silicone, a foam and metal. The materials may be layered, inserted, embedded, etc. without departing from the scope of the invention. However, a characteristic of these materials is the transmission of vibratory motion arising from the active elements within the ADDEV according to embodiments of the invention. Within passive embodiments this characteristic of material selection is removed.

Within the embodiments of the invention with active elements these are mounted to predetermined portions of the shell which is surrounded by the casing. Other embodiments may exploit a passive inserted portion mimicking a dildo function rather than a vibrator. As noted above the ADDEV according to embodiments of the invention may, in addition, to a silicone outer comprise one or more materials to provide mechanical structures such as ridges, shell, scaffold, etc. whilst the casing is smooth.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A device comprising:

an annular region configured to receive a body portion of a user;

an outer casing of predetermined geometry and dimensions; and an actuator disposed between the annular region and outer casing for imparting a mechanically induced physical sensation, wherein wherein:

the actuator is an electrical hollow shaft motor with an asymmetric weight coupled to the hollow shaft motor; and the annular region is within a central hollow region of an electrical hollow shaft motor.

2. The device according to claim 1, wherein the electrical hollow shaft motor is adapted to impart, when in use:

a mechanically induced physical sensation to the user when fitted to the body portion of the user; and another mechanically induced physical sensation to another user via the outer casing to a body region of the another user when the device is either in contact with or inserted into the body region of the another user.

3. The device according to claim 1, wherein the mechanically induced physical sensation is frictional contact;

the actuator further comprises either:

a first element disposed on an inside of the annular region coupled to either a stator or a rotor of the electrical hollow shaft motor; and a second element disposed on an outside of the outer casing coupled to either the stator or the rotor of the electrical hollow shaft motor.

4. The device according to claim 1, wherein the first element is contoured on the inner surface disposed towards an axis of the electrical hollow shaft motor; and the second element is contoured on the outer surface disposed away from the axis of the electrical hollow shaft motor.

5. The device according to claim 4, wherein the annular region fits over a predetermined region of each attachment of a plurality of attachments; and each attachment has a first portion comprising a first predetermined geometry and a second portion comprising a second predetermined geometry for insertion into or through the annular region.

6. A device comprising:

an electrical hollow shaft motor comprising a rotor and stator, the hollow shaft having a central opening sized to fit over a defined body portion of a user;

an outer casing of predetermined geometry and dimensions defining an annular region configured to fit over the defined body portion of the user, wherein the annular region is within the central opening of the electrical hollow shaft motor which imparts a first physical sensation to the user's defined body portion when in use.

7. The device according to claim 6, wherein the electrical hollow shaft motor has an asymmetrically disposed weight attached to it.

8. The device according to claim 6, wherein the electrical hollow shaft motor has an element attached to a rotating rotor of the electrical hollow shaft motor to impart friction based contact to the defined body portion of the user when in use.

9. The device according to claim 6, wherein the electrical hollow shaft motor has an element attached to a rotating rotor of the electrical hollow shaft motor to impart friction based contact to another user in contact with the device.

10. The device according to claim 1, wherein the electrical hollow shaft motor has an element attached to a rotating rotor of the electrical hollow shaft motor to impart friction based contact to the body portion of the user; or the electrical hollow shaft motor has an element attached to a rotating rotor of the electrical hollow shaft motor to impart friction based contact to another user in contact with the device.

11. A device comprising:

an annular region configured to receive a body portion of a user;

an outer casing of predetermined geometry and dimensions; and an actuator disposed between the annular region and outer casing for imparting a mechanically induced physical sensation, wherein:

the actuator comprises an electromagnetic piston based actuator disposed around the annular region;

the electromagnetic piston based actuator comprises a plurality of pistons disposed radially around the annular region; and the mechanically induced physical sensation is vibration.

12. The device according to claim 11, wherein the outer casing comprises at least a resilient layer having a pair of first projections upon it and a flexible layer having a second projection disposed upon it towards the resilient layer and between the pair of first projections;

the actuator surrounds a predetermined portion of the annular region of the device and comprises:

a first actuator disposed between the resilient layer, the flexible layer, the second projection and a first projection of the pair of first projections; and a second actuator disposed between the resilient layer, the flexible layer, the second projection and the other projection of the pair of first projections; inflation of the first actuator moves the first projection of the pair of first projections relative to the resilient layer and therein the flexible layer in a first direction;

inflation of the second actuator moves the other projection of the pair of first projections relative to the resilient layer and therein the flexible layer in a second direction opposite to the first direction; and the mechanically induced physical sensation is friction based contact.

13. The device according to claim 6, further comprising:

a second electrical hollow shaft motor comprising a rotor and stator, the hollow shaft of the second electrical hollow shaft motor having a central opening sized to fit over the defined body portion of the user, wherein the annular region of the outer casing is within the central opening of the second electrical hollow shaft motor.

14. The device according to claim 6, further comprising:

a second electrical hollow shaft motor comprising a rotor and stator, the hollow shaft of the second electrical hollow shaft motor having a central opening sized to fit over a second defined body portion of the user, wherein outer casing defines a second annular region within the central opening of the second electrical hollow shaft motor.

* * * * *